US010096230B2

(12) United States Patent
Glynn

(10) Patent No.: US 10,096,230 B2
(45) Date of Patent: Oct. 9, 2018

(54) SAFETY DEVICE, SYSTEM AND METHOD OF USE

(71) Applicant: Makusafe Corp, Ankeny, IA (US)

(72) Inventor: Gabriel Glynn, Ankeny, IA (US)

(73) Assignee: MAKUSAFE CORP, West Des Moines, IA (US)

( * ) Notice: Subject to any disclaimer, the term of this patent is extended or adjusted under 35 U.S.C. 154(b) by 0 days.

(21) Appl. No.: 15/614,835

(22) Filed: Jun. 6, 2017

(65) Prior Publication Data

US 2017/0352242 A1 Dec. 7, 2017

Related U.S. Application Data

(60) Provisional application No. 62/346,231, filed on Jun. 6, 2016.

(51) Int. Cl.
*G08B 23/00* (2006.01)
*G08B 21/14* (2006.01)
*G08B 25/01* (2006.01)

(52) U.S. Cl.
CPC ..... *G08B 21/14* (2013.01); *G08B 25/016* (2013.01)

(58) Field of Classification Search
CPC ..... G08B 21/14; G08B 25/016; G08B 25/10; H04W 4/22
USPC ..... 340/573.1
See application file for complete search history.

(56) References Cited

U.S. PATENT DOCUMENTS

| | | | | |
|---|---|---|---|---|
| 9,659,484 | B1 * | 5/2017 | Mehta | G08B 25/016 |
| 9,721,456 | B2 * | 8/2017 | Thurlow | G08B 25/016 |
| 2005/0073426 | A1 * | 4/2005 | Hines | G08B 25/016 340/691.1 |
| 2008/0180243 | A1 * | 7/2008 | Aaron | G08B 21/04 340/540 |
| 2013/0271264 | A1 * | 10/2013 | Page | G08B 25/016 340/6.1 |
| 2014/0266793 | A1 * | 9/2014 | Velado | G08B 25/08 340/870.16 |
| 2017/0127257 | A1 * | 5/2017 | Saxena | H04W 4/22 |
| 2017/0140637 | A1 * | 5/2017 | Thurlow | G08B 25/016 |
| 2017/0330446 | A1 * | 11/2017 | Thurlow | G08B 25/016 |

* cited by examiner

*Primary Examiner* — John A Twell, Jr.
(74) *Attorney, Agent, or Firm* — Christopher A. Proskey; BrownWinick Law Firm

(57) ABSTRACT

A safety device that is worn by a worker in a manufacturing facility is presented. The safety device includes a microprocessor, memory, an antenna and transceiver and a plurality of sensors that sense environmental conditions surrounding the worker such as light levels, noise levels, temperature, humidity, air quality and CO levels. The safety device also tracks the position of the worker and includes an accelerometer that detects trips and falls. The safety device also includes an event trigger which can be activated by the worker when a notable event or near miss occurs. The environmental information recorded by the safety device is used to both track accidents and near misses and is aggregated in a database for datamining purposes so as to predict future accidents and near misses. This information is also used to create correlations and better understand the root cause of accidents and near misses.

21 Claims, 19 Drawing Sheets

SAFETY DEVICE, SYSTEM AND METHOD OF USE

CROSS-REFERENCE TO RELATED APPLICATIONS

The present application claims priority to U.S. Provisional Patent Application No. 62/346,231 which was filed on Jun. 6, 2016, entitled SAFETY DEVICE, SYSTEM AND METHOD OF USE which is hereby incorporated by reference herein in its entirety, including any figures, tables, or drawings or other information.

FIELD OF THE DISCLOSURE

This disclosure relates to a safety device. More specifically and without limitation, this disclosure relates to a wearable safety device, system and method of use that is used to track and help predict workplace accidents and the environmental conditions surrounding workplace accidents.

BACKGROUND OF THE DISCLOSURE

Injuries at work are tremendously costly for both the corporation as well as the injured worker. As an example, it is estimated that 2016 will again see nearly 100 billion dollars in workers compensation claims. It is estimated that the average claim in the United State in 2016 will amount to over $100,000.

Most, if not all of these work-related injuries are avoidable. In view of the personal cost to the injured worker and the financial cost to the employer, a great amount of energy and effort has been placed on avoiding workplace injuries. Many employers have implemented various systems to avoid accidents ranging from common sense solutions to sophisticated systems, from establishing safety teams and safety managers to hiring third-party safety auditors, and everything in-between. However, despite these many efforts, avoidable injuries continue to occur at an alarming pace.

Due to the complex nature of today's modern manufacturing facility, the root causes of these workplace injuries are often difficult to discern. This is true, even after an injury has occurred. This complexity makes it even more difficult to predict when, where, why and how an injury may occur in the future.

With that said, information is available that may help shed light on dangerous conditions or situations within a manufacturing facility. However, collecting this information, especially in aggregate, has never before been possible or attempted.

In addition, while every worker and employer wants to avoid workplace injuries, reporting information that relates to worker safety is sometimes a sensitive topic. This is because some workers do not want to be seen as complainers or tattletales and other workers just don't care enough to take active steps to improve workplace safety. As such, much of the information that may help avoid future work place injuries, such as near misses or perceptively dangerous conditions, often goes unreported or uncollected.

Complicating matters further, when information is reported, it is often subjective and very much up to interpretation by both the party providing the information as well as the party receiving the information. However, again, there is not available on the market, a system or device that collects aggregate information about the environmental conditions of a workplace in an unbiased manner which may be used to determine and/or predict safety conditions and therefore help prevent workplace injuries.

Therefore, there is a need in the art to provide a safety device, system and method of use for collecting, reporting and analyzing information about the environmental conditions of a workplace that can be used to reduce work place injuries.

Thus, it is a primary object of the disclosure to provide a safety device, system and method of use that improves upon the state of the art.

Another object of the disclosure is to provide a safety device, system and method of use that standardizes the collection of information about the environmental conditions of a workplace.

Yet another object of the disclosure is to provide a safety device, system and method of use that does not penalize any one employee for reporting information about the environmental conditions of a workplace.

Another object of the disclosure is to provide a safety device, system and method of use that aggregates a great amount of information about the environmental conditions of a workplace.

Yet another object of the disclosure is to provide a safety device, system and method of use that eliminates bias in the collection of information about the environmental conditions of a workplace.

Another object of the disclosure is to provide a safety device, system and method of use that eliminates the inconsistency in reporting information about the environmental conditions of a workplace.

Yet another object of the disclosure is to provide a safety device, system and method of use that provides workers the ability to quickly and easily report notable events, suggestions, near misses or any other information at the moment the information or suggestion occurs and in an easy, fast, and contemporaneous manner.

Another object of the disclosure is to provide a safety device, system and method of use that allows for the prediction of future workplace injuries.

Yet another object of the disclosure is to provide a safety device, system and method of use that allows for the elimination of future workplace injuries.

Another object of the disclosure is to provide a safety device, system and method of use that provides insight into the safety conditions of a workplace.

Yet another object of the disclosure is to provide a safety device, system and method of use that allows for the identification of patterns in safety conditions.

Another object of the disclosure is to provide a safety device, system and method of use that reports information about the environmental conditions of a workplace without substantially inconveniencing workers.

Yet another object of the disclosure is to provide a safety device, system and method of use that provides notifications if safety thresholds are approached or exceeded.

Another object of the disclosure is to provide a safety device, system and method of use that improves the access to information about the environmental conditions of a workplace.

Yet another object of the disclosure is to provide a safety device, system and method of use that improves the visibility to information about the environmental conditions of a workplace.

Another object of the disclosure is to provide a safety device, system and method of use that reduces workplace injuries.

Yet another object of the disclosure is to provide a safety device, system and method of use that improves the safety of workers and work places.

Another object of the disclosure is to provide a safety device, system and method of use that is safe to use.

Yet another object of the disclosure is to provide a safety device, system and method of use that is easy to use.

Another object of the disclosure is to provide a safety device, system and method of use that is efficient to use.

Yet another object of the disclosure is to provide a safety device, system and method of use that provides a unique solution.

Another object of the disclosure is to provide a safety device, system and method of use that is cost effective.

Yet another object of the disclosure is to provide a safety device, system and method of use that is durable.

Another object of the disclosure is to provide a safety device, system and method of use that is robust.

Yet another object of the disclosure is to provide a safety device, system and method of use that can be used with a wide variety of manufacturing facilities.

Another object of the disclosure is to provide a safety device, system and method of use that is relatively inexpensive.

Yet another object of the disclosure is to provide a safety device, system and method of use that has a long useful life.

Another object of the disclosure is to provide a safety device, system and method of use that is high quality.

Yet another object of the disclosure is to provide a safety device, system and method of use that is convenient.

Another object of the disclosure is to provide a safety device, system and method of use that can be used with a wide variety of employees.

Yet another object of the disclosure is to provide a safety device, system and method of use that provides high quality data.

Another object of the disclosure is to provide a safety device, system and method of use that provides data and information that can be relied upon.

Yet another object of the disclosure is to provide a safety device, system and method of use that allows for reduced response time to potential safety issues.

Another object of the disclosure is to provide a safety device, system and method of use that allows for companies to compare the safety of their facilities to other facilities inside the same company and outside the company to determine how safe their facilities are in comparison.

These and countless other objects, features, or advantages of the present disclosure will become apparent from the specification, figures and claims.

SUMMARY OF THE DISCLOSURE

A safety device that is worn by a worker in a manufacturing facility is presented. The safety device includes a microprocessor, memory, an antenna and transceiver and a plurality of sensors that sense environmental conditions surrounding the worker such as light levels, noise levels, temperature, humidity, air quality and CO levels. The safety device also tracks the position of the worker and includes an accelerometer that detects trips and falls. The safety device also includes an event trigger which can be activated by the worker when a notable event or near miss occurs. The environmental information recorded by the safety device is used to both track accidents and near misses and is aggregated in a database for datamining purposes so as to predict future accidents and near misses. This information is also used to create correlations and better understand the root cause of accidents and near misses.

BRIEF DESCRIPTION OF THE DRAWINGS

FIG. 9A is an elevation view of the top side of the system shown in FIGS. 5 through 9, the view showing the core fully inserted within the opening of the holster; the view showing the band removed; the view showing a light pipe positioned in the core that provides access for light in the environment to be sensed by a light sensor; the view also showing a plurality of openings in the core that provides access to other sensors in the core, such as a sound sensor and an air quality sensor, or the like;

DETAILED DESCRIPTION OF THE DISCLOSURE

Figure 1:
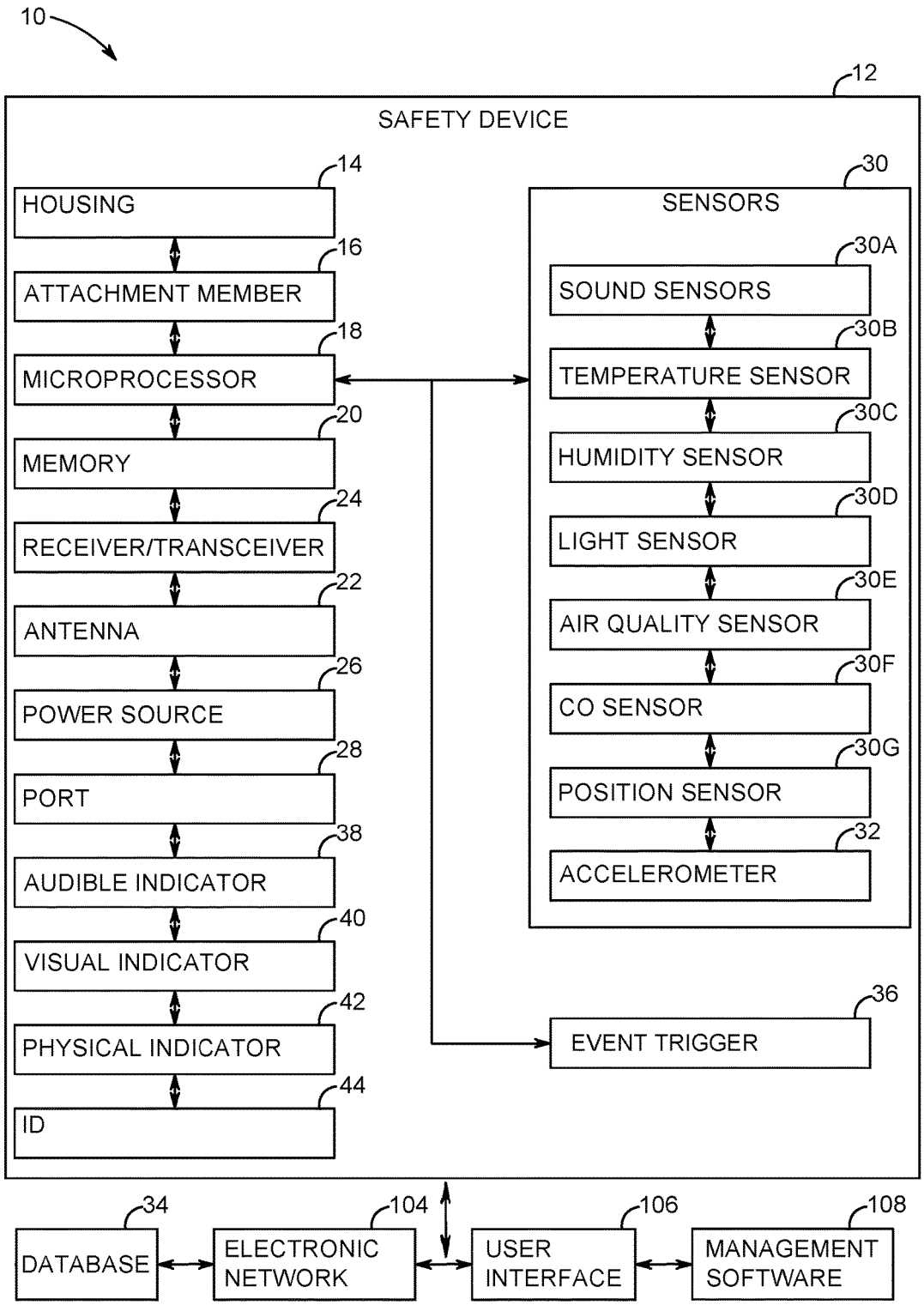
FIG. 1 is a plan view of the system including a safety device having a housing or core, an attachment member, at least one microprocessor, at least one memory, a receiver and/or transceiver, an antenna, a power source, a port, an audible indicator, a visual indicator, a physical indicator, an ID, and a plurality of sensors including sound sensors, temperature sensors, humidity sensors, light sensors, air quality sensors, CO censors, position sensors and an accelerometer, to name a few, the safety device also includes an event trigger; the safety device is included as part of a system including a database, an electronic network, a user interface and management software; the system facilitates the collection and analyzation of worker activities and movements and facilitates the detection, tracking, identification and response to accidents, near misses and notable events or suggestions.
Figure 2:
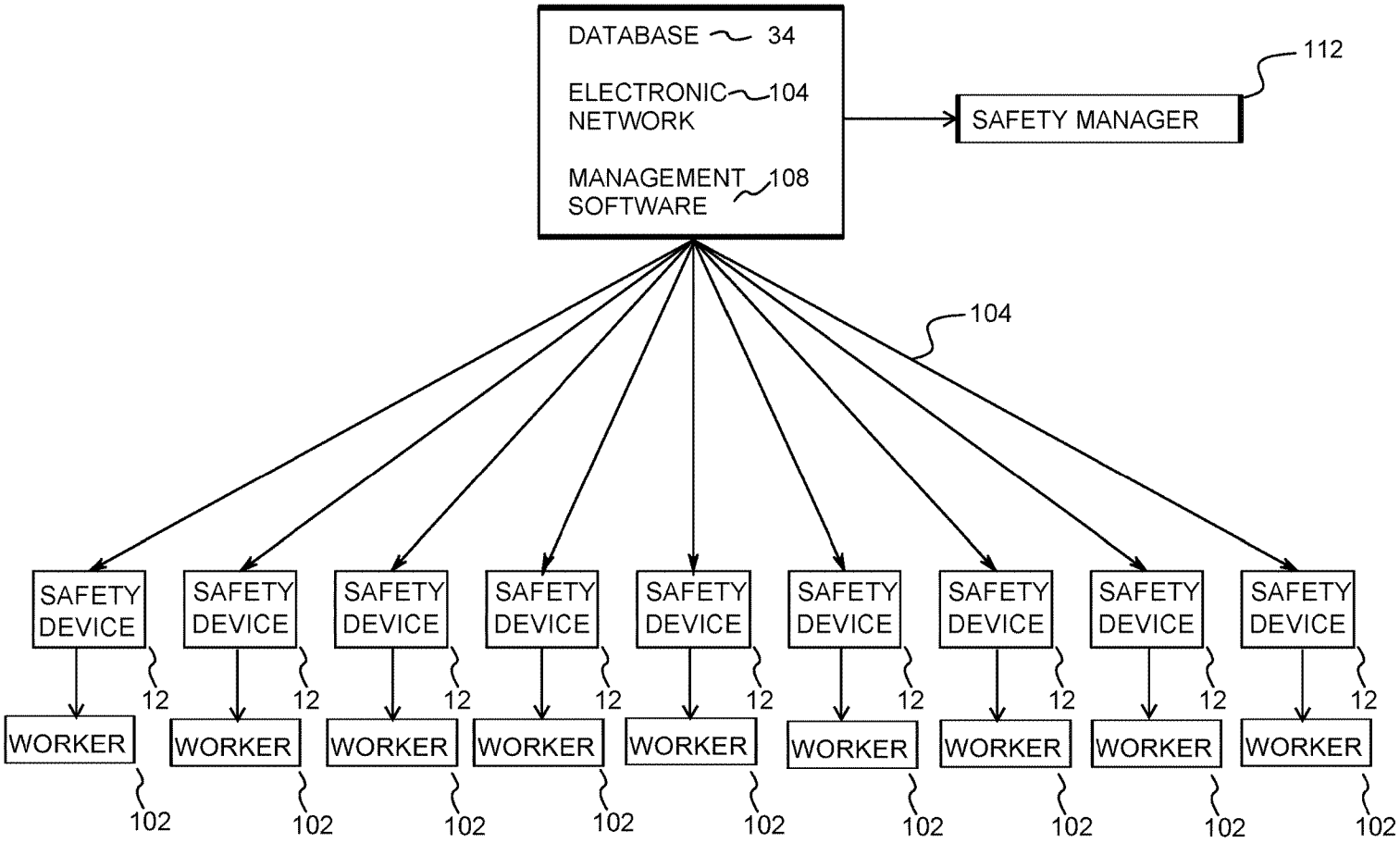
FIG. 2 is a plan view of the system described in FIG. 1, the view showing a plurality of safety devices, each assigned to a worker; the view showing these safety devices in communication with the database, electronic network and management software; the view showing information from the safety devices flowing to a safety manager for the safety manager's attention to the information provided by the safety devices including to accidents, near misses and notable events or suggestions.
Figure 3:
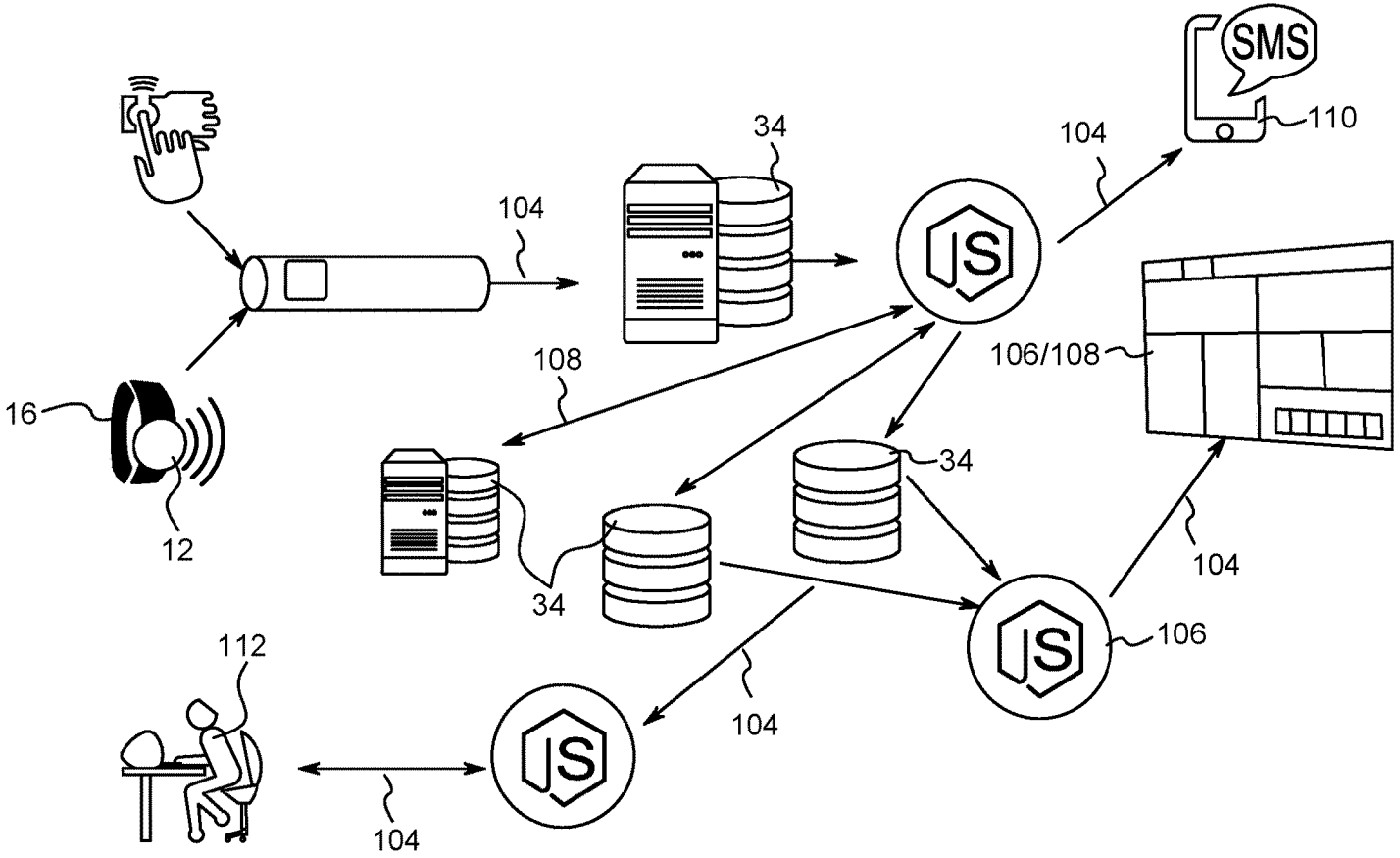
FIG. 3 is a plan view of the system described in FIGS. 1 and 2, the view showing a safety device in electronic communication with the components of the system including a database, user interface and management software, the view also showing the safety device in communication with a safety manager and/or in communication with the electronic device of a safety manager.
Figure 4:
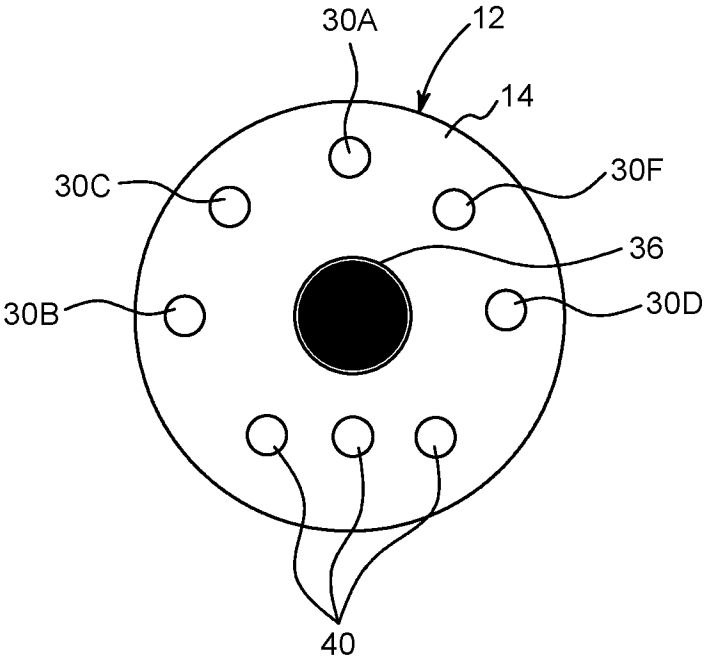
FIG. 4 is an elevation view of one configuration of a safety device, the view showing a core having a generally circular peripheral shape, the view showing the safety device having an event trigger, a plurality of sensors, and a plurality of visual indicators.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure (s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the disclosure.

With reference to the figures, a safety device system 10 is presented (system 10). System 10 includes a plurality of safety devices 12. Safety devices 12 are formed of any suitable size, shape and design and are configured to record information that is pertinent to worker safety, such as environmental conditions as well as near misses.

In one arrangement, as is shown, safety device 12 includes a core 14. Core 14 is formed of any suitable size, shape and design and is configured to house, hold and shelter the components of safety device 12.

In one arrangement, safety device 12 is configured to be worn by a worker 102 and in this way, safety device 12 is considered to be a wearable device. To facilitate being worn by a worker 102 while working, an attachment member 16 is connected to or formed into safety device 12 and/or core 14 of safety device 12. In one arrangement, as is shown, attachment member 16 is a band, strap, belt, elastic strap or the like, that is attachable to a worker's arm wrist, waist or other part of the body or clothing worn by the worker 102. In one arrangement, it is desirable to attach the safety device 12 to the worker's non-dominant arm while working. Alternatively, attachment device 16 is formed of any other device that connects two components together such as a snap-fit member, a clip, hook-and-loop arrangement, a button, a snap, a zipper-mechanism, a zip-tie member, or the like, just to name a few. As another arrangement, safety device 12 can be attached to or formed as part of a piece of clothing or equipment, such as a safety vest, a helmet or the like. In one arrangement, as is further described herein, core 14 of safety device 12 is held within a holster 120 in a removable manner and attachment member 16 is connected to holster 120, as is further described herein.

In one arrangement, as is shown, safety device 12 includes a plurality of electronic components that are configured to act in concert with one another carry out the purpose and function of safety device 12, which is to detect record and report information about the environmental conditions of a workplaces surrounding a worker 102 while working. In one arrangement, safety device 12 includes one or more microprocessors 18 and memory 20. Microprocessor 18 is any electronic device which receives inputs, such as signals or information, and processes it in accordance with instructions stored in memory 20. Memory 20 is any device which stores information and allows for retrieval of this information upon command. In one arrangement, microprocessor 18 may have its own onboard memory 20 and microprocessor 18 and memory 20 may be a single unitary and combined component. In another arrangement, memory 20 may be one or more standalone units that are electrically connected to microprocessor 18. In yet another arrangement, microprocessor 18 may have its own onboard memory 20 as well as being connected to memory 20 that is a standalone unit, or any combination thereof. As such, it is hereby contemplated that safety device 12 may include multiple microprocessors 18 (which may or may not have their own onboard memory 20) and/or multiple devices which serve as memory 20.

In one arrangement, safety device 12 includes a pair of microprocessors 18, with one microprocessor 18 primarily devoted to controlling the operation of recording the sound surrounding the worker 102, and the other microprocessor 18 devoted to controlling the other operations of the safety device 12.

In one arrangement, as is shown, safety device 12 includes an antenna 22 which is operatively connected to a receiver, transmitter and/or a transceiver 24 (hereinafter referred to as transceiver 24). Antenna 22 is any device which receives and/or transmits wireless signals. A receiver is any device that receives wireless signals from antenna 22, processes these signals and transmits them to microprocessor 18 or other electronic components. In this way, a receiver receives information from antenna 22. A transmitter is any device that receives signals from microprocessor 18, or other electronic components, processes these signals and transmits them through antenna 22 for over the air broadcasting. In this way, a transmitter transmits information through antenna 22. A transceiver 24 is any device which is capable of operating as both a receiver and a transmitter. It is hereby contemplated that safety device 12 includes a receiver, or a transmitter or both a receiver and transmitter, which may be a single combined electronic device, separate devices or a plurality of devices. Reference shall be made herein to "transceiver 24" for purposes of simplicity; however, reference to the term "transceiver" shall be understood to include a receiver alone, a transmitter alone, a receiver and a transmitter, a transceiver or any combination thereof. Transceiver 24 may be configured to communicate using any protocol such as Wi-Fi, Bluetooth, Bluetooth Low Energy, ZigBee, Zwave or any other communication protocol. The use of a transceiver 24 that facilitates two-way communication facilities the transmission of over-the-air updates to cores 14 from a central processor or command center which ensures that the software and/or firmware of the core 14 is always up to date.

In the arrangement shown, as one example, safety device 12 includes a power source 26 which is operatively connected to the electronic components of safety device 12 such that power source 26 provides power to these electronic components. Power source 26 is formed of any suitable size, shape and design. In one arrangement, power source 26 is formed of one or more replaceable/disposable batteries. In another arrangement, power source 26 is formed of one or more rechargeable batteries.

In one arrangement, as is shown, safety device 12 includes a port 28 which is operatively connected to the electronic components of safety device 12. Port 28 is formed of any suitable size, shape and design and is configured to allow for the reception and transmission of information as well as charging of on board power source 26.

In one arrangement, as is shown, safety device 12 includes a plurality of sensors 30. Sensors 30 are formed of any suitable size, shape and design and are configured to sense environmental conditions surrounding the worker 102 while working. In one arrangement, safety device 12 includes a plurality of sensors 30.

In one arrangement, safety device 12 includes a sound sensor 30A. Sound sensor 30A is formed of any suitable size, shape and design and is configured to detect the volume level and/or frequency of sound surrounding the worker 102. In one arrangement, sound sensor 30A is a microphone that is accessible through one or more openings 114 in core 14 that provide unfettered access for the sound to reach the microphone. Sound sensor 30A allows for the detection of elevated sounds, abrupt spikes in sounds, loud noises, irritating or distracting frequencies or the like. Sound sensor 30A also allows for the detection of when a volume threshold is approached or exceeded.

In one arrangement, safety device 12 includes a temperature sensor 30B. Temperature sensor 30B is formed of any suitable size, shape and design and is configured to detect the temperature of the environment surrounding the worker 102. The same and/or an additional temperature sensor 30B may be configured to detect the temperature of the worker 102 themselves. In one arrangement, temperature sensor 30B is a thermometer. Temperature sensor 30B allows for the detection of high or low temperatures as well as abrupt changes in temperature. Temperature sensor 30B also allows for the detection of when a temperature threshold is approached or exceeded.

In one arrangement, safety device 12 includes a humidity sensor 30C. Humidity sensor 30C is formed of any suitable size, shape and design and is configured to detect the humidity of the environment surrounding the worker 102. The same and/or an additional humidity sensor 30C may be configured to detect the humidity level, moisture level or perspiration level of the worker 102 themselves. Humidity sensor 30C allows for the detection of high or low levels of humidity as well as abrupt changes in humidity. Humidity sensor 30C also allows for the detection of when a humidity threshold is approached or exceeded.

In one arrangement, safety device 12 includes a light sensor 30D. Light sensor 30D is formed of any suitable size, shape and design and is configured to detect the light levels of the environment surrounding the worker 102. Light sensor 30D allows for the detection of high or low levels of light as well as abrupt changes in light levels. Light sensor 30D also allows for the detection of when a light threshold is approached or exceeded. In one arrangement, light sensor is operably connected to and/or accessible by a light pipe 116. Light pipe 116 is any device that facilitates the collection and transmission of light from the environment surrounding the worker 102. In one arrangement, light pipe 116 is a clear, transparent or translucent material that extends from the exterior of the core 14 to the light sensor 30D and therefore covers and protects light sensor 30D while enabling the sensing of light conditions.

In one arrangement, safety device 12 includes an air quality sensor 30E. Air quality sensor 30E is formed of any suitable size, shape and design and is configured to detect the air quality of the environment surrounding the worker 102, the particulate matter in the air of the environment surrounding the worker 102, the contaminant levels in the air of the environment surrounding the worker 102, or any particular contaminant level in the air surrounding the worker 102 (such as ammonia, chlorine, or any other chemical, compound or contaminant). Air quality sensor 30E allows for the detection of high contaminant levels in the air as well as abrupt changes in air quality. Air quality sensor 30E also allows for the detection of when an air quality threshold is approached or exceeded.

In one arrangement, air quality sensor 30E is a total volatile organic compound sensor, also known as a TVOC sensor. Volatile organic compounds (or VOCs) are organic chemicals that have a high vapor pressure at ordinary room temperature. VOCs are numerous, varied, and ubiquitous. They include both human-made and naturally occurring chemical compounds. Most scents or odors are of VOCs. In this arrangement, air quality sensor 30 is configured to detect VOCs. Also, in one arrangement, air quality sensor 30E is accessible through one or more openings 114 in core 14 that provide unfettered access and airflow for sensing by air quality sensor 30E.

In one arrangement, safety device 12 includes a carbon monoxide (CO) sensor 30F. CO sensor 30F is formed of any suitable size, shape and design and is configured to detect CO levels of the environment surrounding the worker 102. CO sensor 30F allows for the detection of high CO levels in the air as well as abrupt changes in CO levels. CO sensor 30F also allows for the detection of when a CO threshold is approached or exceeded. Of course, sensor 30F, or additional sensors 30, may be used to sense other gasses in the air around the worker 102, such as carbon dioxide, ozone, or any other gas or other content of the air around the worker 102. Also, in one arrangement, sensor 30F is accessible through one or more openings 114 in core 14 that provide unfettered access and airflow for sensing by sensor 30F.

In one arrangement, safety device 12 includes a position sensor 30G. Position sensor 30G is formed of any suitable size, shape and design and is configured to detect the position of the worker 102 within the manufacturing facility. Notably, the term manufacturing facility is to be construed in a broad manner and may include being within one or a plurality of buildings. However, the manufacturing facility may include being outside and unconstrained by the boundaries of a building or any particular grounds. Position sensor 30G allows for the detection of movement of the worker 102 within the manufacturing facility, the speed of movement of the worker 102 within the manufacturing facility, the tracking of the position of the worker 102 within the manufacturing facility, among any other speed, location, direction, inertia, acceleration or position information. This position information can be aggregated over the course of the worker's shift to determine the amount of distance traveled by the worker 102, the average speed, the mean speed, the highest speed, or any other information. In addition, this position information can be aggregated to determine the areas where the worker 102 concentrated their time. In addition, this position information can be correlated with the information detected by the other sensors to determine the concentration of certain environmental factors in different areas of the manufacturing facility. Position sensor 30 may be a GPS device, a Wi-Fi device that utilizes triangulation from known points, a Wi-Fi device that utilizes trilateration from known points, or any other device that detects the position of safety device 12 and the worker 102.

In one arrangement, safety device 12 includes an accelerometer 32. Accelerometer 32 is formed of any suitable size, shape and design and is configured to detect acceleration and/or movement of the safety device 12, such as when a worker 102 trips on something on the floor and almost falls, or when a worker 102 falls off of a ladder, is hit by a fork truck, or has another traumatic event. Accelerometer 32 may be formed of any acceleration detecting device such as a one axis accelerometer, a two axis accelerometer, a three axis accelerometer or the like. Accelerometer 32 also allows for the detection changes in acceleration, detection of changes in direction as well as elevated levels of acceleration.

In an alternative arrangement or in addition to an accelerometer 32, a gyroscope or gyro-sensor may be used to provide acceleration and/or movement information. Any form of a gyro is hereby contemplated for use, however in one arrangement a three-axis MEMS-based gyroscope, such as that used in many portable electronic devices such as tablets, smartphones, and smartwatches is contemplated for use. These devices provide 3-axis acceleration sensing ability for X, Y, and Z movement, and gyroscopes for measuring the extent and rate of rotation in space (roll, pitch and yaw).

In another arrangement and/or in addition to an accelerometer 32, a magnetometer may be used to provide acceleration and/or movement information. Any form of a magnetometer that senses information based on magnetic fields is hereby contemplated for use. In one arrangement, a magnetometer is used to provide absolute angular measurements relative to the Earth's magnetic field. In one arrangement, an accelerometer, gyro and/or magnetometer are incorporated into a single component or a group of components that work in corresponding relation to one another to provide up to nine axes of sensing in a single integrated circuit providing inexpensive and widely available motion sensing.

Safety device 12 may also include any other sensors 30. In one arrangement, safety device 12 includes sensor 30 that tracks the heartbeat of the worker 102 and in this arrangement sensor 30 is a heartbeat sensor. In one arrangement, safety device 12 includes sensor 30 that tracks the blood pressure of the worker 102 and in this arrangement sensor 30 is a blood pressure sensor. In one arrangement, safety device 12 includes sensor 30 that tracks the blood alcohol level of the worker 102 and in this arrangement sensor 30 is a blood alcohol sensor. In one arrangement, safety device 12 includes sensor 30 that tracks the brain waves of the worker 102 and in this arrangement sensor 30 is a brain wave sensor. Any other sensor 30 can be added to core 14.

During operation, sensors 30 detect environmental conditions, such as sound, temperature, humidity, light, air quality, CO levels, TVOC levels, particulate levels, position and acceleration information, direction information, speed information and the like respectively. This information is periodically and/or continuously transmitted to microprocessor 18 and/or stored in memory 20. This information is also periodically and/or continuously transmitted through transceiver 24 and antenna 22 and is communicated to and stored in a database 34 where it is aggregated and analyzed to detect patterns as is described further herein.

Safety device 12 includes an event trigger 36. Event trigger 36 is formed of any suitable size, shape and design and is configured to allow a worker 102 to indicate that a notable event just occurred, such as an accident that almost occurred (also known as a near miss), such as when the worker 102 trips and almost falls, when the worker 102 is almost struck by a forklift, when products almost fall on the worker 102, when the worker 102 is almost injured by a tool, or the like near misses.

Also, workers 102 are encouraged to use event trigger 36 when a notable event occurs. This may be any information that the worker 102 believes would be helpful for the safety manager 112 to know about or others in the management of the manufacturing facility. This may include a suggestion as to how to improve the manufacturing facility, problems associated with the layout of the manufacturing facility, the worker 102 noticing that equipment is wearing and likely to fail in the near future, that ear plugs, safety glasses or other protective equipment is failing, that a door fails to lock, that another employee is behaving strangely or taking unnecessary risks, or practically any other information. It has been tested that providing the worker 102 with the instantaneous ability to record suggestions or information at the moment the information dawns on the worker 102, reduces the barriers to providing this information and as such, this information is more-readily provided as it is very easy to provide. In addition, because the information is provided contemporaneous with the worker 102 experiencing the notable event, it has been found that the information is provided in a thorough, unbiased, honest and straight forward manner. Or said, another way, when a worker 102 waits to report improvements or issues at the end of the shift the worker 102 is likely to be uninclined to go through the reporting process, they are likely to forget salient details or their memory of events could fade. In contrast, by providing an easy and contemporaneous recordation of the notable event at or just after the time the event occurs, the information provided tends to be pure and uncorrupted. Due to the ease of simply pressing the event trigger 36 the worker 102 is likely to report the information. More accurate reporting and more frequent reporting allows a safety manager 112 or management in general to be more aware of the issues in the manufacturing facility and able to continuously improve the manufacturing facility. In addition, the timeliness of this information cannot be matched as it is transmitted to the safety manager 112 and/or database 34 as soon as it is recorded and as soon as the safety device 12 establishes connectivity with database 34 and/or charger base 118 or another wireless communication intermediary, such as a repeater.

In one arrangement, event trigger 36 is a button, switch or other device placed on or formed in safety device 12 that allows the worker 102 to indicate that a notable event (such as a near miss) just occurred. At the time the event trigger 36 is activated, the safety device 12 records and/or transmits and/or saves a higher level or high-density of environmental information such as sound, temperature, humidity, light, air quality, CO levels, position and acceleration and the like and transmits this information to database 34. This high-density environmental information is stored along with an audible message provided by the worker 102 explaining why they engaged the event trigger 36. In one arrangement, the safety device 12 continually tracks and stores a predetermined amount of high-density data, such as sixty-seconds two minutes, thirty seconds or the like. This high-density data is tracked and stored in a rolling manner. That is, the high-density data is overwritten or converted to low-density data unless an event occurs that causes the safety device 12 to save and transmit the high-density data.

As one example, when event trigger 36 is activated, the safety device 12 stores this high-density information for transmission through port 28 when safety device 12 is connected to charger base 118, or the safety device 12 transmits this information wirelessly over the air through antenna 22 when wireless connectivity is established with charger base 118 and/or database 34. When event trigger 36 is not activated, safety device 12 stores and/or transmits a lower level or low-density of information, or overwrites a portion of the high-density information. That is, by way of example, high-density information may include storing and/or transmitting a sample from sensors 30 once every hundredth of a second or tenth of a second, whereas low-density information may include storing and transmitting a sample from sensors once every second or once every two seconds, or the like. In this way, a balance can be had between recording a high sensitivity of information at and just prior to the time an accident, near miss or notable event occurs, while recording enough information to develop patterns and predict potential accidents while not being overly encumbered by too much data when an accident, near miss or notable event situation has not occurred.

In one arrangement, when event trigger 36 is activated, the sound sensor 30A, or microphone, is activated for a predetermined time or period thereafter. This allows the worker 102 to voice record the events of the accident, near miss or notable event contemporaneously, or just after, the event occurs. This allows for an honest and relatively unbiased account of the event shortly after the near miss occurs. This voice recording can be converted into text and automatically inserted into an event report, or alternatively the voice recording itself may be inserted directly into an event report. In one arrangement, the audio recording through sound sensor 30A occurs for a predetermined amount of time such as for thirty seconds or a minute after the event trigger 36 is pressed. In another arrangement, the audio recording through sound sensor 30A occurs for so long as the safety device 12 detects that the worker 102 is talking. In another arrangement, the audio recording through sound sensor 30A occurs for so long as the worker 102 depresses or engages the event trigger 36. In another arrangement, sound sensor 30 records the audio for a length of time or period determined by any other manner, method or means.

In one arrangement, to eliminate or reduce unintentional engagement of the event recording function of safety device 12, safety device 12 is configured to require a special engagement or unlock procedure to start the event recording function. In one arrangement, a double engagement or double press of event trigger 36 is required to engage the event recording function. In another arrangement, an elongated press of event trigger 36 is required to engage the event recording function.

In yet another arrangement, an accident or near miss or other safety matter can be distinguished from a notable event (such as a suggestion for improvement of a process or the factory layout by a worker 102) by the manner in which the event trigger 36 engaged. As one example, a safety issue is reported by pressing the event trigger 36 twice and a notable event that is not related to immediate safety concerns is reported by pressing the event trigger 36 three times. Alternatively two different triggers 36, such as two buttons, can be provided one dedicated for safety issues the other dedicated for non-safety issues. Or any other manner of reporting safety issues and non-safety issues may be used. By separating the reporting of safety issues from non-safety issues, this allows reports of safety issues, accidents and near misses to be expedited through the system 10, such as immediately emailing or texting them to a safety manager 112 or other manager so that they can respond quickly to safety issues while allowing non-safety issues to be handled as a lower priority. In one arrangement, the report of safety issues is instantaneously reported over the air to charger base 118 and/or database 34 and is thereafter contemporaneously, immediately and/or quickly sent to a safety manager's phone, email, text message or the like for their immediate attention. In contrast, non-safety related matters are stored on safety device 12 and downloaded once core 14 is installed in charger base 118. In this way, the system 10 includes an expedited path for the report of notable events that are safety issues and the system 10 includes a non-expedited path for the report of notable events that are not safety issues.

In one arrangement, safety device 12 includes one or more audible indicators 38. Audible indicator 38 is formed of any suitable size, shape and design and is configured to provide an audible indication to the worker 102 when a hazard condition may be present or when a safety threshold is approached or exceeded or when any other event or issue occurs that the worker 102 should be informed of. In one arrangement, audible indicator 38 is a speaker, or any other device that is configured to produce or repeat a sound, such as a tone, an alarm, audible instructions or any other sound.

As an example, when the decibel level in the environment surrounding the worker 102 reaches 90% of the safety threshold sound, as is sensed by sound sensor 30A, the microprocessor 18 detects that a safety threshold is approached and issues an alarm or a prerecorded spoken voice instruction or any other audible indication through audible indicator 38, which informs the worker 102 to retreat from the potentially unsafe condition. Audible indicator 38 may also be used to provide any instructions to the worker 102, such as telling them through a voice command to join a mandatory meeting in the lobby, informing them of a fire alarm or contaminant alarm, providing them with their schedule for the day, providing them with the goals for the day, providing them with instructions for the day, or providing information on any other condition or instruction.

In one arrangement, safety device 12 includes one or more visual indicators 40. Visual indicator 40 is formed of any suitable size, shape and design and is configured to provide a visual indication to the worker 102 when a hazard condition may be present or when a safety threshold is approached or exceeded or when any other event or issue occurs that the worker 102 should be informed of. In one arrangement, visual indicator 40 is one or more lights, LEDs or any other illuminating device placed in core 14 which illuminates. In one arrangement, visual indicator 40 is formed of a red, a green and a blue LED which illuminate in various ways to provide various information. However any other number of lights or LEDs are hereby contemplated for use as is any other color of lights or LEDs.

As an example, when the air quality in the environment surrounding the worker 102 reaches a first safety threshold as is detected by the microprocessor 18 though air quality sensor 30E (e.g. exceeds 80% of a safety threshold) a first light of the visual indicator 40 is illuminated, such as the blue LED; when the air quality in the environment surrounding the worker 102 reaches a second safety threshold as is detected by the microprocessor 18 though air quality sensor 30E (e.g. exceeds 90% of a safety threshold) a second light of the visual indicator 40 is illuminated, such as the green LED, or both the green and the blue LED are illuminated; when the air quality in the environment surrounding the worker 102 reaches a third safety threshold as is detected by the microprocessor 18 though air quality sensor 30E (e.g. reaches or exceeds 100% of a safety threshold) a third light of the visual indicator 40 is illuminated, such as the red LED, or the green, blue and red LEDs are illuminated. Illumination of visual indicators 40 informs the worker 102 to retreat from the potentially unsafe condition or location.

In another arrangement, various visual indicators 40 may be used to provide information regarding the state of operation of safety device 12. As an example, one light of the visual indicators 40 of the safety device 12 may be illuminated when the safety device 12 is powered and operational, such as illumination of a blue LED. As another example, one light of the visual indicators 40 of the safety device 12 may be illuminated when the power source 26 of safety device 12 reaches a power or charge threshold as is sensed by microprocessor 18, such as falling below a 10% charge level and as such illumination of this visual indicator 40 informs the worker 102 it is time to charge the safety device 12. As another example, one light of the visual indicators 40 of the safety device 12 may be illuminated when the safety device 12 is wirelessly connected to the internet, a hub, or other communication device.

In one arrangement, safety device 12 includes one or more physical indicators 42. Physical indicator 40 is formed of any suitable size, shape and design and is configured to provide a physical indication to the worker 102 when a hazard condition may be present or when a safety threshold is approached or exceeded or when any other event or issue occurs that the worker 102 should be informed of. In one arrangement, physical indicator 42 is a vibration device placed in core 14 which vibrates upon command. As an example, when the air quality in the environment surrounding the worker 102 reaches a first safety threshold as is detected by the microprocessor 18 though air quality sensor 30E (e.g. exceeds 90% of a safety threshold) physical indicator 42 activates. Upon sensing this vibration or physical indication from physical indicator 42, the worker 102 retreats from the potentially unsafe condition.

Any other form of indicator is hereby contemplated for use with safety device 12 and is used to provide information to the worker 102. As an example, in one arrangement, core 14 may connect to a worker's headphones or other listening device (such as an earbud) through port 28, or wirelessly through wireless pairing, and when information becomes available, such as an announcement or reaching or exceeding a safety threshold, the safety device 12 transmits an audible signal to the worker's headphones or listening device. In this way, by connecting, either through a wired connection or wirelessly to the worker's headphones or other listening device the safety device 12 provides audible information directly to the worker 102 thereby eliminating or reducing the possibility that the worker 102 does not hear the information due to the noisy environment.

Safety device 12 includes an ID 44. ID 44 is any form of a unique identifier that identifies any one particular safety device 12 from other safety devices 12 used within a manufacturing facility. In one arrangement, ID 44 is a code that can be scanned, such as a bar code, QR code or other code. In another arrangement, ID 44 is a unique identifier that is contained within a near field communication (1\TC) chip or other communication device. In another arrangement, ID 44 is a serial number. Any other form of identification is hereby contemplated for use as ID 44.

In Operation:

As one example, system 10 is used in a manufacturing facility 100 (not shown) having a plurality of workers 102 and an electronic network 104. System 10 includes a user interface 106 connected to the electronic network 104 and database 34, which is operated and controlled by management software 108. A plurality of safety devices 12, one for each worker 102 are used to track near misses and reduce workplace accidents in the following manner.

At the beginning of a shift, workers 102 are assigned a safety device 12. The unique ID 44 of the safety device 12 is associated with the particular worker 102 by entering the ID 44 into database 34 by any means such as scanning, NFC, typing, biometric scanning, random allocation, or the like. In this assignment, the particular worker 102 is assigned to the particular core 14 and specific rules or guidelines are associated with the core 14 for use with that particular worker 102. As an example, safety thresholds for a worker 102 that works with loud pressing machines and wears external ear muffs may be much higher than a worker 102 that works in shipping and receiving and does not use any hearing protection. In this way, by assigning particular rules for each worker 102 based on that worker's job and tasks, allows the system 10 to provide more accurate information and determine more accurately when safety issues arise for that particular worker 102 because what may be acceptable for one worker's role may not be acceptable for another worker's role.

Once the core 14 is assigned to the worker 102, the worker 102 attaches safety device 12 to themselves, such as placing an elastic strap of attachment member 16 around the worker's non-dominant arm and tightening it by a buckle, Velcro, buttons or any other manner or method. Alternatively, safety device 12 is attached to their helmet, belt, pocket, collar, shirt, or to any other portion of their body or clothing or equipment by any manner or means.

Once attached, the safety device 12 is activated. Upon activation, safety device 12 establishes a wireless connection to database 34 through electronic network 104 and begins sending and receiving pertinent information. Also once activated, safety device 12 begins sensing environmental conditions surrounding the worker 102 through sensors 30.

As an example, where safety device 12 includes a sound sensor 30A, a temperature sensor 30B, a humidity sensor 30C, a light sensor 30D, an air quality sensor 30E, a CO sensor 30*f*, a position sensor 30G and an accelerometer 32, the safety device 12 periodically senses sound, temperature, humidity, light, air quality, CO levels, position and acceleration.

These environmental conditions are sensed and at least temporarily recorded or buffered in high-density (such as one sample every tenth of a second or every hundredth of a second, or the like, or in the example of sound, the sound in the environment is continuously recorded for a predetermined amount of time or period) to onboard memory 20 and/or transmitted through transceiver 24 and antenna 22 through electronic network 104 to database 34.

If an accident or a near miss occurs or a notable event occurs, this high-density of information is retained and stored on database 34 for later analysis. Buffering or retaining a high-density of information allows for an in-depth analysis of the conditions around the time of an accident or near miss. This high-density of information is retained around the time of an accident or near miss as it may shed additional light on the events surrounding the accident or near miss that may not be discernable if only low-density information is retained.

If on the other hand, an accident or near miss is not recorded, this high-density of information is overwritten, or not retained, and instead a low-density of information (such as one sample every half second or every second) is recorded, stored and/or transmitted. Recording and/or transmitting a low-density of information continuously throughout the worker's shift allows for analysis and recordation of environmental information at an appropriate level of detail, while not being overly cumbersome and cumulative and overburdening the system 10 with too much unnecessary information at too high a level of detail.

In one arrangement, safety device 12 periodically transmits environmental information to database 34 through a wireless connection over electronic network 104 (such as when safety device 12 acquires a Wi-Fi connection). In an alternative arrangement, safety device 12 stores environmental information sensed by sensors 30 on onboard memory 20 throughout the worker's shift. Then, at the end of the shift, when safety device 12 is physically plugged into electronic network 104 by port 28 the information stored on memory 20 is downloaded to database 34. Also while plugged in by port 28, the power source 26 is recharged.

Proximity Sensor:

In one arrangement, to ensure the purity of data collected, core 14 includes a proximity sensor or cover-sensor as one of the sensors 30. Proximity sensor is configured to determine when the core 14 is covered, such as when a worker puts a welding jacket on over the core 14, and when it is covered the core 14 takes corrective action, such as shutting down particular sensors, going into a sleep mode and/or filtering out what environmental data (such as light levels, sound levels or air quality as these would be effected by being covered) should not be recorded or reported due to be being covered.

Tripping Example:

As an example, during the worker's shift, safety device 12 continuously senses the environmental conditions around the worker 102 using sensors 30, including the position of the worker 102 within the manufacturing facility, as well as recording the sound around the worker 102. The safety device 12 temporarily stores this information in high-density on the memory 20 of the safety device 12. Unless a notable event, near miss or accident occurs, this high-density of information is overwritten and only a low-density of information is retained on memory 20. This recordation of high-density information and then overwriting the information while only retaining a low-density of information is repeated until, during the worker's shift the worker 102 trips on a pallet that was improperly placed in a high traffic area. Upon tripping on this pallet, the accelerometer 32 senses the unusual acceleration and microprocessor 18 identifies this spike in acceleration as a potential accident or near miss (e.g. the system 10 is configured to apply machine learning and artificial intelligence to determine what are known as "signatures" that indicate a near miss or accident occurred, over time and with the application of more examples and more data, the system 10 becomes smarter and better able to distinguish when an accident or near miss occurs and separates these events from non-events). Microprocessor 18 interprets the information supplied to it through sensors 30 by the instructions stored in memory 20 and is programmed to identify the large spike in acceleration or "tripping signature" as a potential accident or near miss. Upon identifying this tripping incident as a possible accident or near miss, the microprocessor 18 retains the high-density of information for a predetermined amount of time both before and after the accident or near miss (such as 60 seconds before and 60 seconds after or the like).

In one arrangement, in response to sensing this accident or near miss, microprocessor 18 prompts worker 102 to provide a recitation or description of the accident or near miss through an audible indication using audible indicator 38, visual indication using visual indicator 40, a physical indication using physical indicator 42 or any combination of these indicators 38, 40, 42. In one arrangement, the audible indication is an audible tone, such as a beep or series of beeps, or audible instructions such as "A potential accident was detected, please describe what happened." In response, the worker 102 is trained to describe what occurred, which gives the worker 102 an opportunity to contemporaneously describe the events. This eliminates the potential that the worker 102 forgets what happened or confuses what happened in this event with another event.

In an alternative arrangement, the worker 102 is trained to press or engage the event trigger 36 when they experience a near miss or accident. Once the worker 102 presses or engage the event trigger 36 the worker is also trained to speak into the safety device 12 and describe the events that just occurred, or alternatively once the event trigger 36 is pressed or engaged the safety device 12 prompts the worker 102 to provide a description of the events that just occurred.

In one arrangement, upon sensing this accident or near miss, safety device 12 transmits a signal through a wireless connection to electronic network 104 that an accident or near miss just occurred. This signal indicates who the worker 102 is that experienced the accident or near miss through association of the unique ID 44 of safety device 12 to that worker 102, the position of the accident or near miss as is detected by position sensor 30G, as well as the nature of the accident or near miss, which in this example is a potential trip or fall, as is sensed by accelerometer 32. Any other sensed information may also be provided safety device 12. In one arrangement, the audible recording of the worker's description of the accident or near miss is also transmitted, or this audible recitation is automatically converted to text which is transmitted in text form as part of this signal.

As this event is considered an accident or near miss it receives expedited attention. Safety device 12 transmits some or all of the information related to the incident over the air to charger base 118, database management software 108, electronic network 104 or any other communication path or communication device or system that is used in association with the system 10.

Once this signal is received by the system 10, database 34, charger base 118, and/or management software 108, the information is converted into an incident report and a signal, such as a text message, email, or the like is transmitted to an electronic device 110 (such as a cell phone, a handheld device, their own safety device 12, an email account, or any other electronic device capable of receiving an electronic message or information) of one or more safety managers 112 or other managers or other persons in charge of managing safety in the manufacturing facility 100. This signal includes the position/location of the event, time of the event, name of the employee involved and type of potential accident or near miss along with any other pertinent information. In one arrangement, the audible recording of the worker's description of the accident or near miss is also transmitted, or this audible recitation is automatically converted to text which is transmitted in text form as part of this signal. With this timely information, the safety manager 112 can quickly and effectively respond to the potential accident or near miss. This information is also stored as an incident report in database 34 for data mining, data retrieval, heat mapping, machine learning and artificial intelligence purposes.

As this event is a safety event, transmission is expedited through the system 10 so that the safety manager 112, a response team or others can quickly respond in attempt to mitigate the injury or damage. In one arrangement, when this signal indicating a safety event occurred is received, the location of the event is transmitted to a building control or safety system that then implements alarms, flashing lights or other safety precautions in the affected portion of the manufacturing facility to alert others as to the event and in an attempt to prevent further injury or damage.

Once the safety manager 112 arrives at the scene of the accident or near miss they will see that a pallet was placed in a high traffic area. In response, the safety manager 112 can move the pallet or cordon off the area to prevent future accidents and/or take further corrective actions.

Falling Items Example:

As an example, during the worker's shift, safety device 12 continuously senses the environmental conditions around the worker 102 using sensors 30, including the position of the worker 102 within the manufacturing facility, as well as recording the sound around the worker 102. The safety device 12 temporarily stores this information in high-density on the memory 20 of the safety device 12. Unless a notable event, near miss or accident occurs, this high-density of information is overwritten and only a low-density of information is retained on memory 20. This recordation of high-density information and then overwriting the information while only retaining a low-density of information is repeated until, during the worker's shift the worker 102 experiences falling items. As an example, during the worker's shift, the worker 102 climbs up on a ladder to remove some items from a shelf. Upon doing so, a number of items fall and almost strike the worker 102 in the head because they were improperly stacked or stored.

In response to this near miss, the worker 102 presses the event trigger 36. In response to the event trigger 36 being activated, microprocessor 18 retains the high-density of information for a predetermined amount of time both before and after the accident or near miss (such as 60 seconds before and 60 seconds after, or the like).

In one arrangement, in response to the event trigger 36 being activated, microprocessor 18 prompts worker 102 to provide a recitation or description of the accident or near miss through an audible indication using audible indicator 38 or a visual indication using visual indicator 40 or a physical indicator using physical indicator 42. In one arrangement, the audible indication is an audible tone, such as a beep or series of beeps, or audible instructions such as "A potential accident was detected, please describe what happened." In response, the worker 102 is trained to describe what occurred, which gives the worker 102 an opportunity to contemporaneously describe the events. This eliminates the potential that the worker 102 forgets what happened or confuses what happened in this event with another event.

In one arrangement, when the event trigger 36 is activated, indicating that an accident or near miss occurred, safety device 12 transmits a signal through a wireless connection to electronic network 104 that an accident or near miss occurred. This signal indicates who the worker 102 is that experienced the accident or near miss through association of the unique ID 44 of safety device 12, and the position and time of the accident or near miss as is detected by position sensor 30G, as well as the nature of the accident or near miss, which in this example is an activation of the event trigger 36. In one arrangement, the audible recording of the worker's description of the accident or near miss is also transmitted, or this audible recitation is automatically converted to text which is transmitted in text form as part of this signal.

Once this signal is received by the system 10, database 34, charger base 118, and/or management software 108, the information is converted into an incident report and a signal, such as a text message, email, or the like is transmitted to an electronic device 110 (such as a cell phone, a handheld device, their own safety device 12, an email account, or any other electronic device capable of receiving an electronic message or information) of one or more safety managers 112 or other managers or other persons in charge of managing safety in the manufacturing facility 100 (not shown). This signal includes the position/location of the event, time of the event, name of the employee involved and type of potential accident or near miss along with any other pertinent information. In one arrangement, the audible recording of the worker's description of the accident or near miss is also transmitted, or this audible recitation is automatically converted to text which is transmitted in text form as part of this signal. With this timely information, the safety manager 112 can quickly and effectively respond to the potential accident or near miss. This information is also stored as an incident report in database 34 for data mining, data retrieval, heat mapping, machine learning and artificial intelligence purposes.

As this event is a safety event, transmission is expedited through the system 10 so that the safety manager 112, a response team or others can quickly respond in attempt to mitigate the injury or damage. In one arrangement, when this signal indicating a safety event occurred is received, the location of the event is transmitted to a building control or safety system that then implements alarms, flashing lights or other safety precautions in the affected portion of the manufacturing facility to alert others as to the event and in an attempt to prevent further injury or damage.

Once the safety manager 112 arrives at the scene of the accident or near miss they will see that items were stored in the shelving in an unsafe and unstable manner. In response, the safety manager 112 removes the items or cordon off the area to prevent future accidents and/or the safety manager 112 takes further precautionary measures.

Notable Event Example:

As one example, a worker 102 during their shift realizes that they have a suggestion to improve a manufacturing step, to improve a workstation or improve the flow of the manufacturing facility, or any other suggestion or improvement. Without the safety device system 10, the worker 102 would have to walk to the location of either a safety manager 112, facility manager or other manager(s) office and meet with that person to describe their suggestion. This requires the worker to remove themselves from their work, which reduces productivity and could be considered a punishable event. Alternatively, the worker 102 must take time to fill out a suggestion form or log into a computer and send an email to a safety manager 112 or facility manager. Due to the time and inconvenience involved with doing so, workers 102 rarely follow through with reporting their suggestions.

However, in the system 10 presented, when the worker 102 has an idea or suggestion, the worker 102 presses the event trigger 36. In one arrangement, to distinguish this notable event from a safety issue (such as an accident or near miss) the worker 102 presses a separate notable event button or they press the event trigger 36 twice or three times or whatever the configuration is to discern that this engagement of the event trigger 36 is for reporting a notable event or suggestion and not for reporting an immediate safety concern. In doing so, the safety device 12 assigns the event a lower priority, that is not expedited, in the same manner as a safety event.

In one arrangement, in response to the event trigger 36 being activated, in the manner to identify that the worker 102 desires to record or submit a suggestion or identify a notable event, microprocessor 18 prompts worker 102 to provide a recitation or description of the notable event or suggestion through an audible indication using audible indicator 38 or a visual indication using visual indicator 40 or a physical indicator using physical indicator 42. In one arrangement, the audible indication is an audible tone, such as a beep or series of beeps, or audible instructions such as "A notable event was detected, please describe what happened." In response, the worker 102 is trained to describe what occurred or what their suggestions are, which gives the worker 102 an opportunity to contemporaneously describe the events or suggestions at or near the time they occurred. This eliminates the potential that the worker 102 forgets what happened or confuses what happened in this event with another event. This also essentially eliminates the barriers to providing their suggestions for improvement as the worker 102 does not have to leave their work station, they don't have to fill out any paperwork or type out anything (which may be a substantial barrier for many workers 102). In contrast, the worker 102 can simply speak their suggestions while continuing to work. The safety device 12 also stores the information related to the time and place of the notable event, such as location, time, and what the sensors 30 sensed for inclusion in a notable event report.

In one arrangement, when the event trigger 36 is activated in a manner indicating that a notable event has been encountered, the safety device 12 assigns this event a lower priority than a safety issue such as a near miss or an accident. Safety device 12 develops a notable event report which includes the spoken words of the worker 12, which may be retained as spoken words and/or may be converted to text, as well as the time, location and any other pertinent information that is sensed by the sensors 30 of safety device 12.

In one arrangement, this information is stored on memory 20 of safety device 12 until the safety device 12 is connected to charger base 118 at which point the information is transmitted over electronic network 110 to database 34 and other components of the system 10 where the information is contained within a notable event report which is provided to safety manager or facilities manager or other manager or team for their consideration and attention.

In alternative arrangement, this information is stored on memory 20 until it is convenient for safety device 12 to transmit this information over the air to the other components of system 10, such as database 34, charger base 118, and/or management software 108. Again, because the information is deemed not to be an immediate safety concern this information is deemed to be of a lower priority level and is not expedited. Meaning that the safety device 12 may be allowed to transmit the information at a time convenient for the safety device 12, such as when the safety device 12 establishes a strong signal with electronic network 104.

In another arrangement, the information related to the notable event may be treated in the same manner as the safety event information described above. However, by providing notable event information in the same and undiscernible manner as safety information, this has the potential of distracting the safety manager 112 from responding quickly to true safety concerns and issues.

In one arrangement, the system 10 combines all the notable event reports into a signle report that is provided to the safety manager 112, facility manager or other manager or team on a daily, weekly, monthly or quarterly basis, or on any other basis that is convenient and facilitates allocation of proper resources to these notable events.

End of Shift:

At the end of their shift, in association with the process of clocking out, worker 102 removes their safety device 12, scans in the ID 44 and/or plugs safety device 12 in through port 28 into charger base 118 which connects to electronic network 104 (which also charges safety device 12 for the next use) and management software 108 retrieves the information stored on safety device 12 to develop a shift report and/or incident reports and/or notable event reports for the worker's shift.

In one arrangement, after turning in the safety device 12 at the end of their shift, the worker 102 is provided with a log of all items that were sensed as potential accidents or near misses and/or notable events. The information related to each of these potential accidents or near misses and/or notable events is provided to the worker 102 such as time, position, temperature, light level, air quality, volume, CO level, the audible recording or converted text of the contemporaneous recording of the incident or notable event. The worker 102 is then provided the opportunity to confirm or deny whether an accident or near miss or notable event actually occurred, and provide additional information regarding the potential accident or information or notable event. This provides the worker 102 the opportunity to clarify the record and provide additional information.

Threshold Example:

In one arrangement, microprocessor 18 is programmed to indicate whether particular thresholds are exceeded. As an example, when 90% of a volume threshold is exceeded, as is interpreted by microprocessor 18, a signal is transmitted to safety manager 112 informing the safety manager 112 of the potentially dangerous condition. Once received, the safety manager 112 can respond in an attempt to address the problem and reduce the volume in the affected area.

Similarly, when 90% of a volume threshold is exceeded, as is interpreted by microprocessor 18, a signal is transmitted to the worker 102 through audible indicator 38, visual indicator 40 and/or physical indicator 42 indicating to the worker 102 of a potential dangerous condition. This information may be used by the worker 102 to correct the problem or exit the potentially dangerous area.

Mapping and Prediction:

With workers 102 using safety devices 12 and with safety devices 12 tracking the position of the worker 102 while sampling the environmental conditions surrounding workers 102 maps are easily developed of not just actual accidents, but of near misses as well, which is information that was never before easily collected. This information can be used to predict where future accidents or near misses are likely to occur. This information also can be used to inform safety managers 112 of the areas of manufacturing facility 100 (not shown) that are the most dangerous, or could use improvements.

This information can also be used to develop what are known as heat maps which can be used to show the concentration of certain conditions. That is, a heat map can be generated showing the most traveled or busiest areas of the manufacturing facility, a heat map can be generated showing the noisiest areas of the manufacturing facilities, a heat map can be generated showing the areas of the manufacturing facility that has the highest level of air contaminants, a heat map can be generated showing the temperature of the areas of the manufacturing facility, a heat map can be generated showing the light levels of the areas of the manufacturing facility. These heat maps provide insight into the conditions of the manufacturing facility that are actually experienced by the workers 102 themselves and provide insight never before obtained. These heat maps can be used to improve the conditions of the manufacturing facility. For instance, hallways and doorways can be widened at the areas of highest traveled areas, additional lighting can be added to the areas of lowest light, additional ventilation can be added to the areas of worst air quality, additional heating or cooling can be added to areas with the highest or lowest temperature, or any other corrective action can be provided. This ensures that the highest level of impact is provided for each investment. The system 10 also provides a feed-back loop for determining how effective the corrective action was by comparing heat maps before the corrective action and after the corrective action.

When specific areas of the manufacturing facility 100 (not shown) are identified as the most likely to have an accident, information collected by sensors 30 of safety devices 12 can be used to determine the root cause of the accidents or near misses, such as low light levels, or high temperatures or low temperatures, or high volumes or high pitched volumes, too much congestion in high traffic areas or any other condition. Also, correlations can be generated between the great amount of aggregate data and information collected by safety devices 12 and accidents or near misses to reveal further information that can be used to reduce or eliminate accidents or near misses in the future.

The information from safety devices 12 and the correlations between the information and increased likelihood of accidents or near misses can be used to implement solutions, such as increasing lighting in accident-prone areas with insufficient lighting; widening hallways in accident prone congested areas, moving noisy tooling in accident prone areas with high volume levels, or the like.

In one arrangement, information about the environmental conditions of a workplace from a plurality of safety devices 12 used by a plurality of workers 102 over a period of time is aggregated into database, software, algorithms, artificial intelligence and/or any other data processing systems, manners or methods are used to detect correlations in the environmental conditions or other data and near misses and/or work place injuries.

Facility Layout:

Another benefit of the system 10 is that it tracks the position of workers 102 during the entire time they wear the safety device 12. As such, for the first time, a facilities manager has an accurate and unbiased start-to-finish track of the worker's travel path. Based on this information, the facilities manager can see the efficiencies and inefficiencies of the plant lay out and the facilities manager can redesign the facility layout based on this information. Once changes to the layout are made, the system 10 also provides a feed-back loop for determining how effective the corrective action was by comparing the travel paths or distances of workers 102 before the corrective action and after the corrective action. The facilities manager can get a numerical value on how far the worker 102 walked before and after the implementation of the new design. The facilities manager can use this information to calculate cost savings and justify the cost of implementing system 10 as well as the cost of implementing facility changes. The less time the worker 102 walks around the facility in theory the more time the worker can spend working which in theory leads to higher efficiencies, higher productivity and higher profits.

Safety OSHA Audit and Workers Comp Claims:

One benefit of using system 10 is that the information collected by safety devices 12 may be used as evidence to show compliance in OSHA audits and therefore may reduce the liability of the company. Another benefit of using system 10 is that the information collected by safety devices 12 may be used as evidence in worker comp claims and therefore may reduce the liability of the company. Another benefit of merely implementing the system 10 as well as utilizing the information provided by the system 10 is that this may reduce the insurance premiums (as the system 10 helps to prevent and avoid costly injuries).

In one arrangement, when an accident does occur, the system 10 is configured to format information and data collected by the data to be entered directly into the required fields of an OSHA accident report. This saves time, money and ensures that the proper and thorough information is provided.

Figure 5:
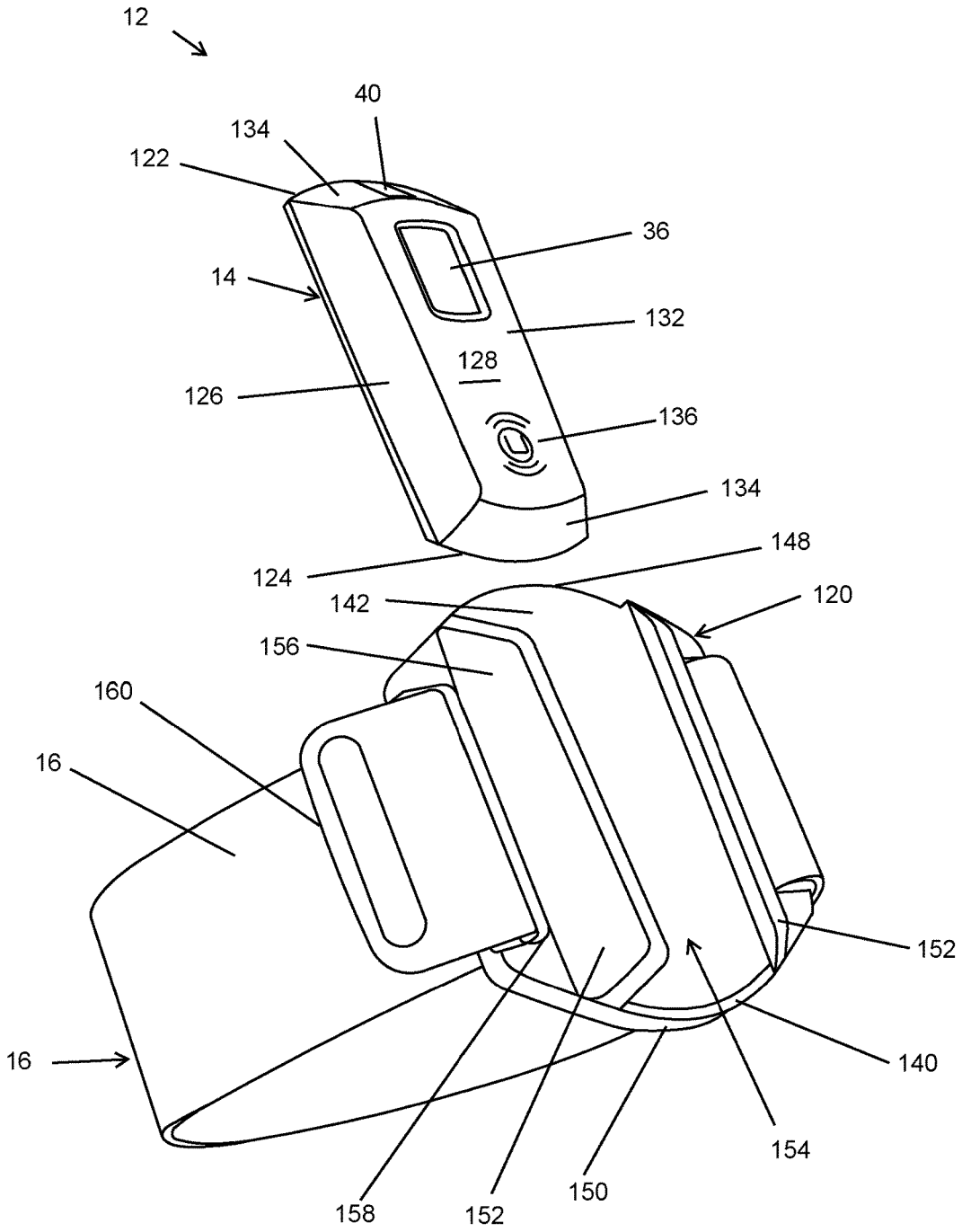
FIG. 5 is a perspective view of another configuration of a safety device, the view showing the safety device having an elongated core having an upper end, lower end, opposing sides, a forward wall, a back wall, and opposing end walls, the safety device having an event trigger positioned within its forward wall, and a visual indicator positioned in its upper end wall; the view showing the core sized and shaped to fit within an opening of a holster, the holster having a back wall and a pair of side walls and a step that are configured to receive and hold the core therein; the view showing the holster connected to an attachment device that is in the form of a band that is configured to fit around the wrist or arm of a worker; the view showing the core about to be inserted within the opening of the holster.
Figure 6:
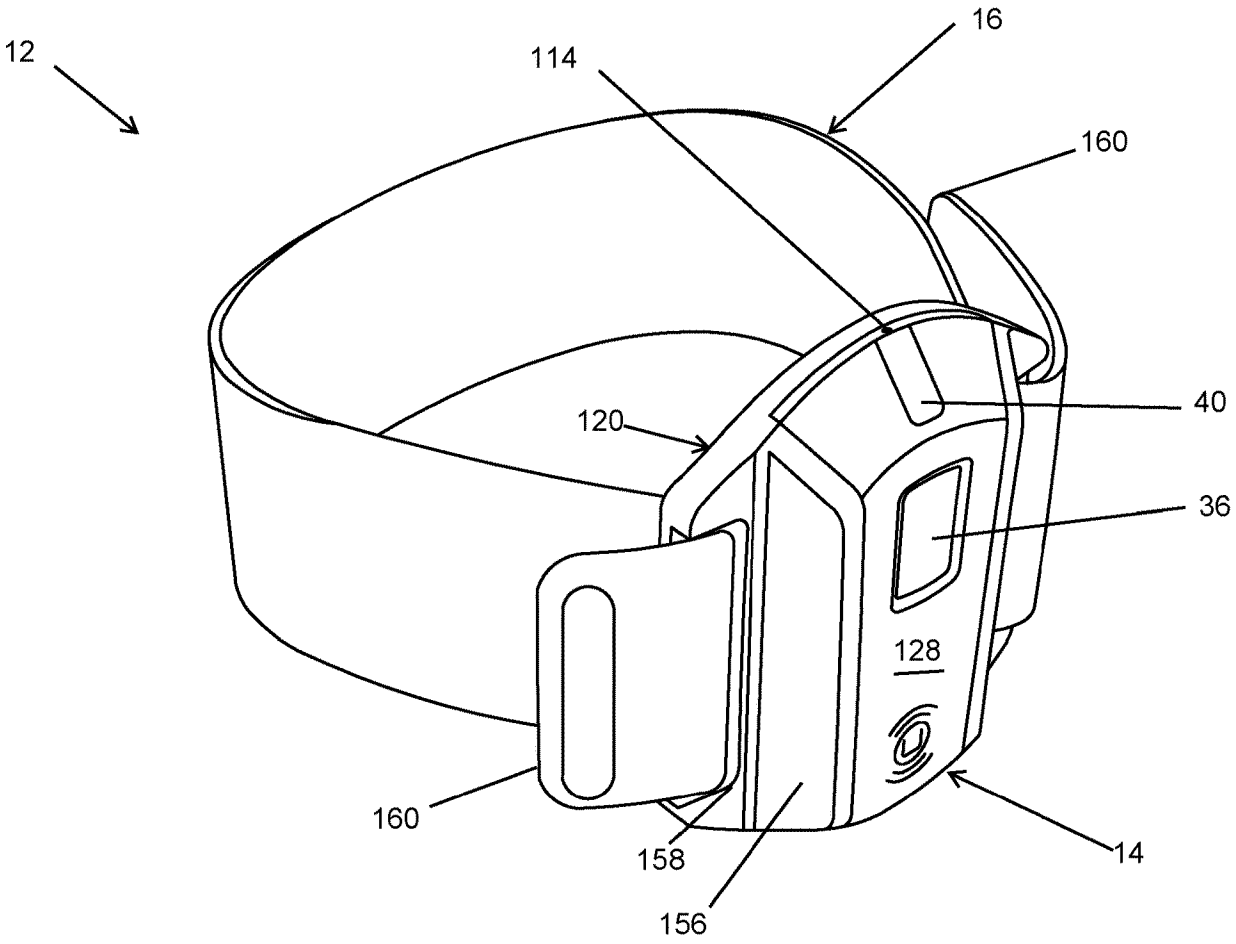
FIG. 6 is a perspective view of the system shown in FIG. 5, the view showing the core fully inserted within the opening of the holster; the view also showing an opening in the upper end of the core to provide access to sensors housed within the hollow interior of the core.
Figure 7:
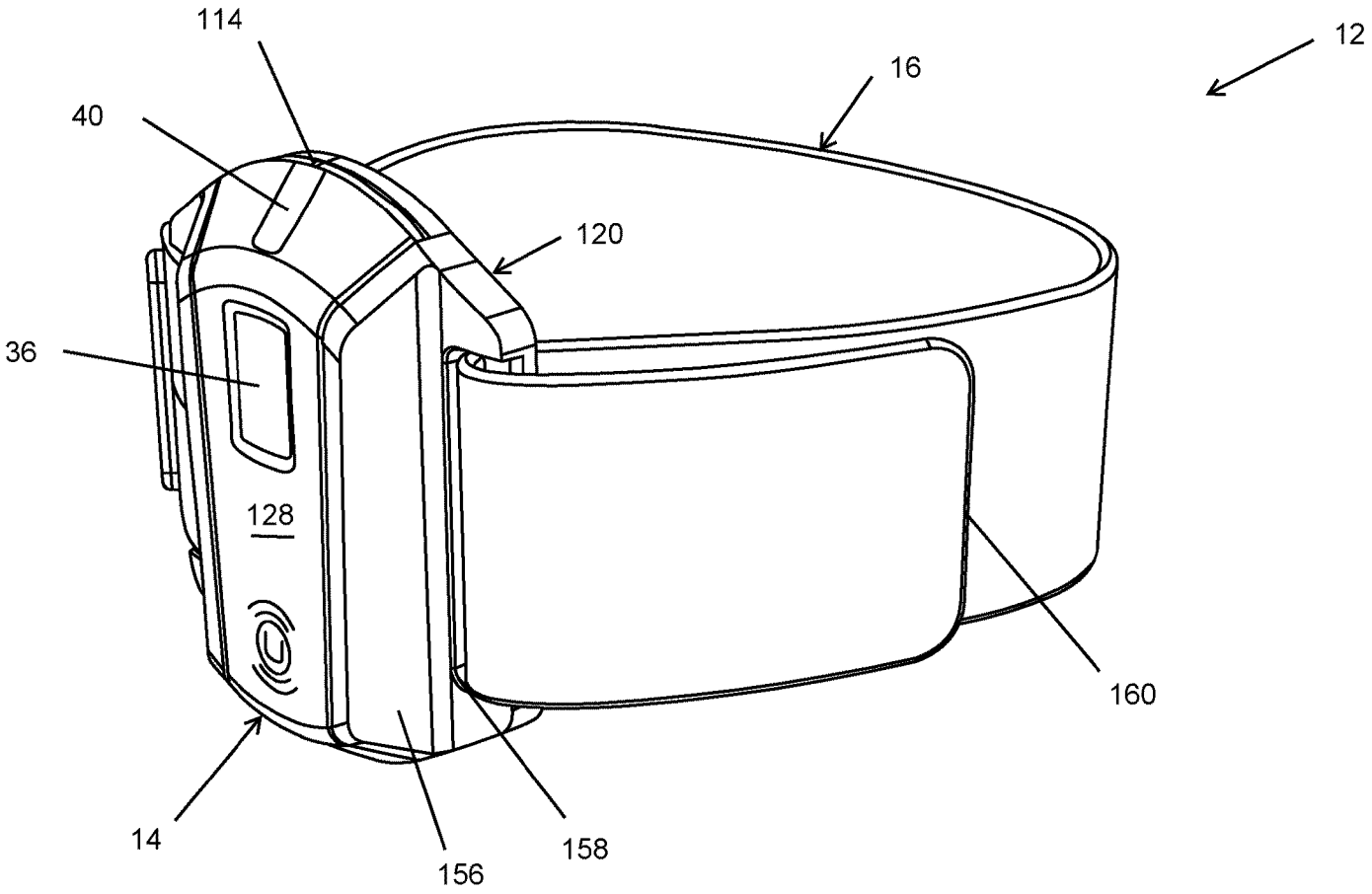
FIG. 7 is another perspective view of the system shown in FIGS. 5 and 6, the view showing the core fully inserted within the opening of the holster; the view also showing an opening in the upper end of the core to provide access to sensors housed within the hollow interior of the core.
Figure 8:
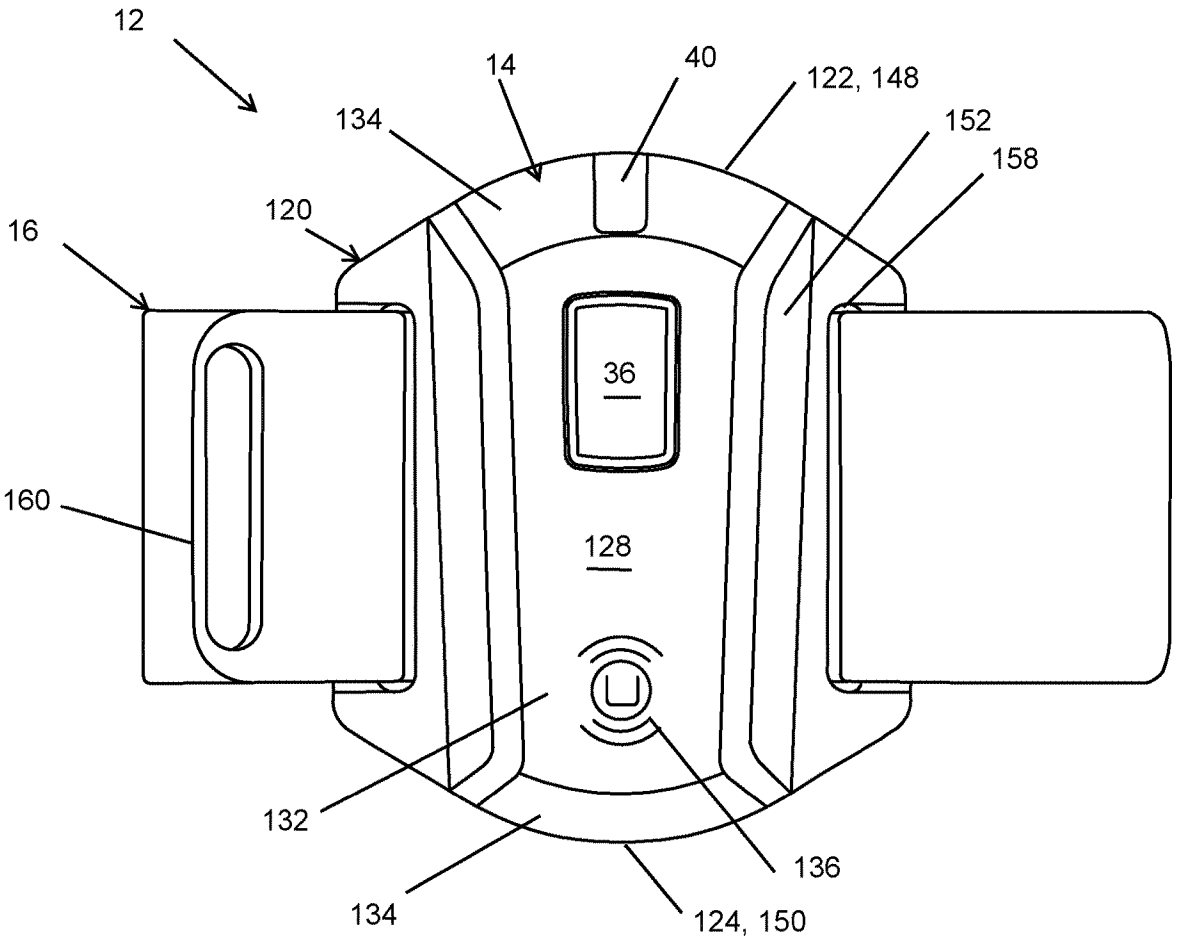
FIG. 8 is an elevation view of the front side of the system shown in FIGS. 5 through 7, the view showing the core fully inserted within the opening of the holster.
Figure 9:
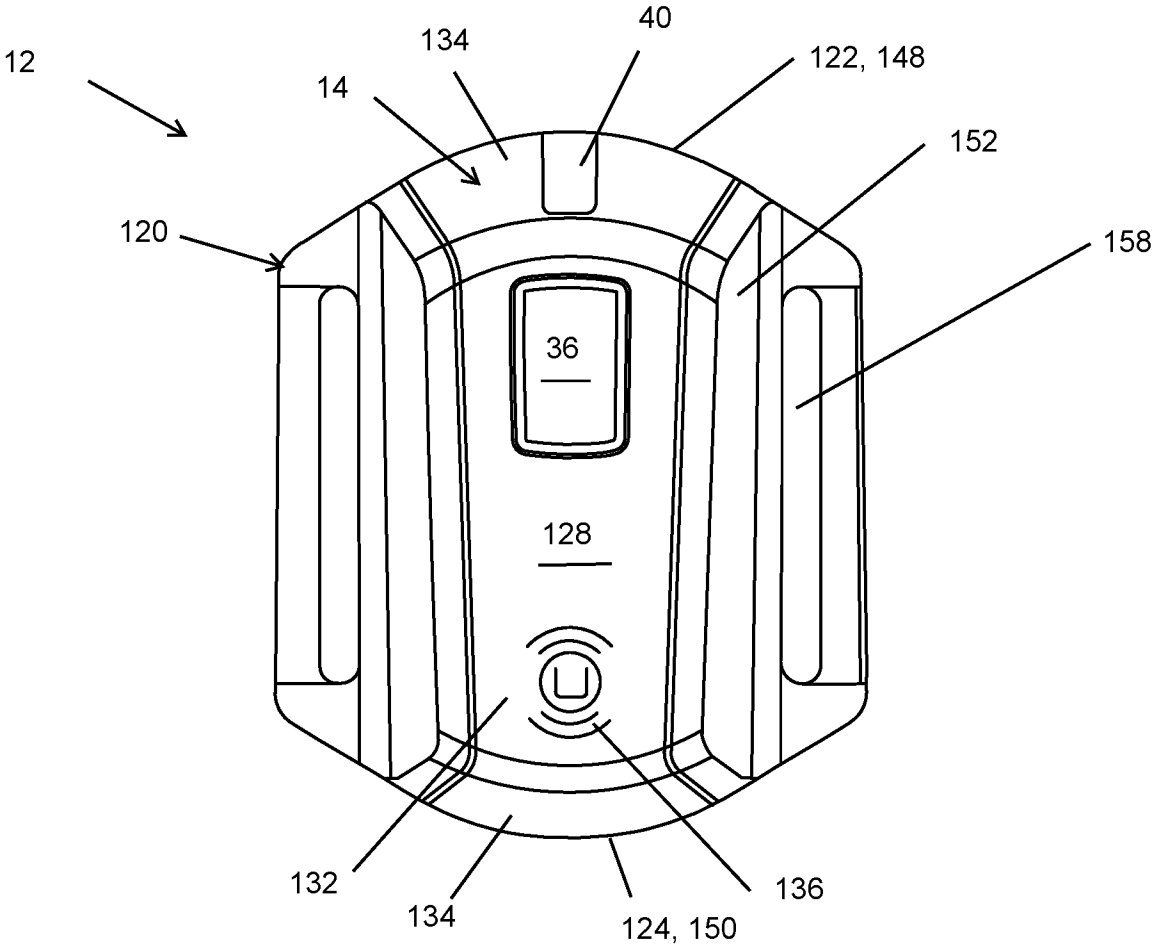
FIG. 9 is an elevation view of the front side of the system shown in FIGS. 5 through 8, the view showing the core fully inserted within the opening of the holster; the view showing the band removed.
Figure 9A:
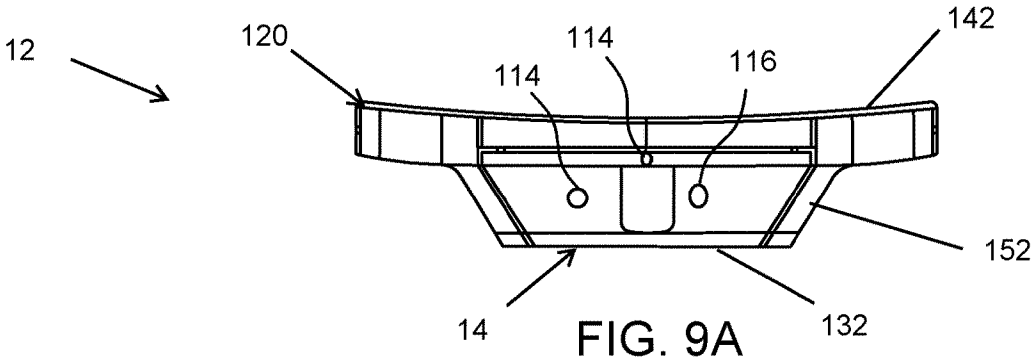
Figure 9B:
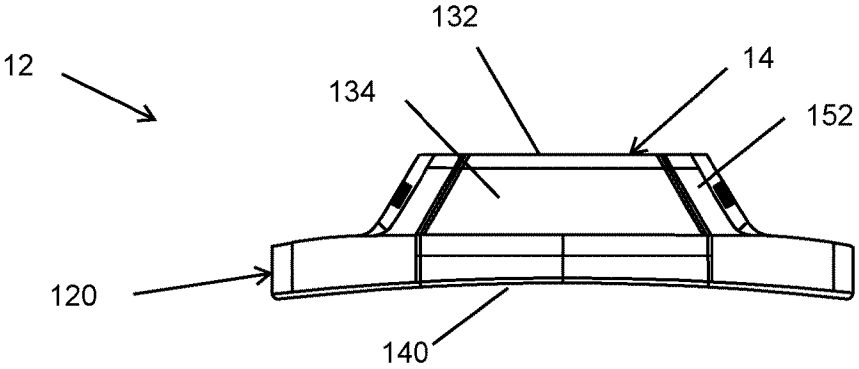
FIG. 9B is an elevation view of the bottom side of the system shown in FIGS. 5 through 9, the view showing the core fully inserted within the opening of the holster; the view showing the band removed.
Figure 9D:
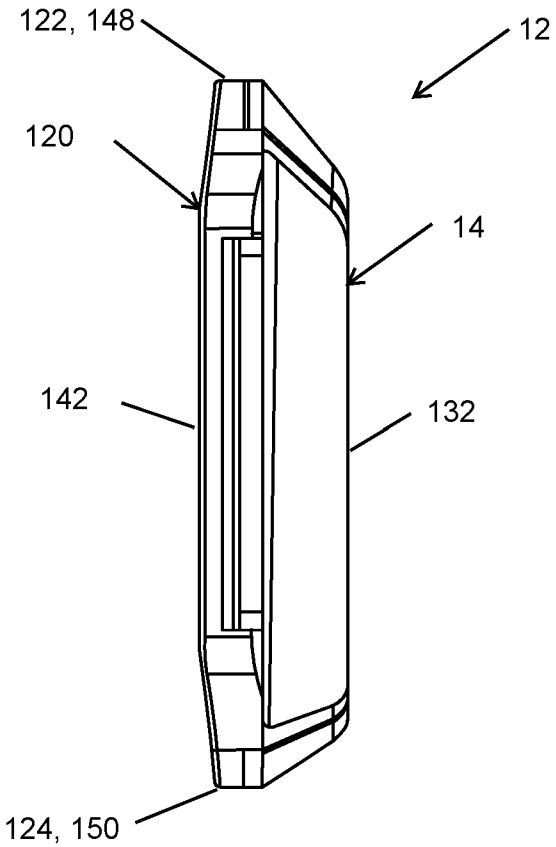
FIG. 9D is an elevation view of the right side of the system shown in FIGS. 5 through 9, the view showing the core fully inserted within the opening of the holster; the view showing the band removed.
Figure 9C:
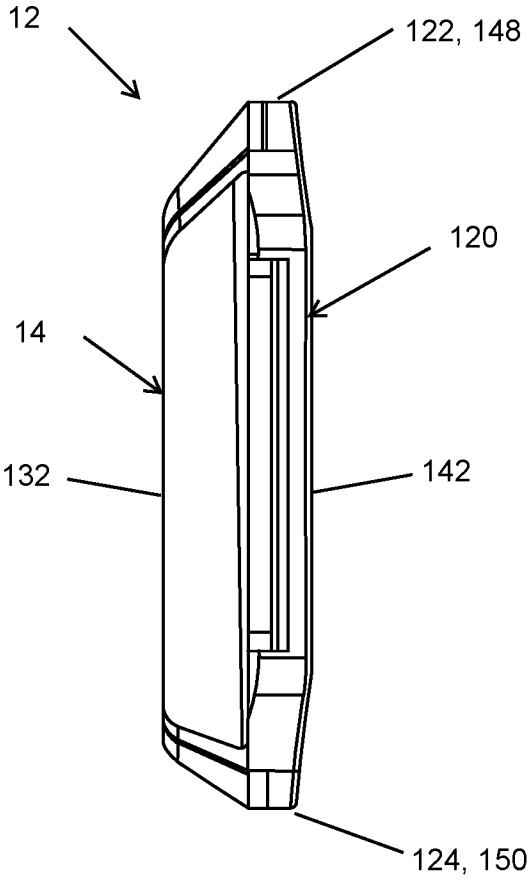
FIG. 9C is an elevation view of the left side of the system shown in FIGS. 5 through 9, the view showing the core fully inserted within the opening of the holster; the view showing the band removed.
Figure 10:
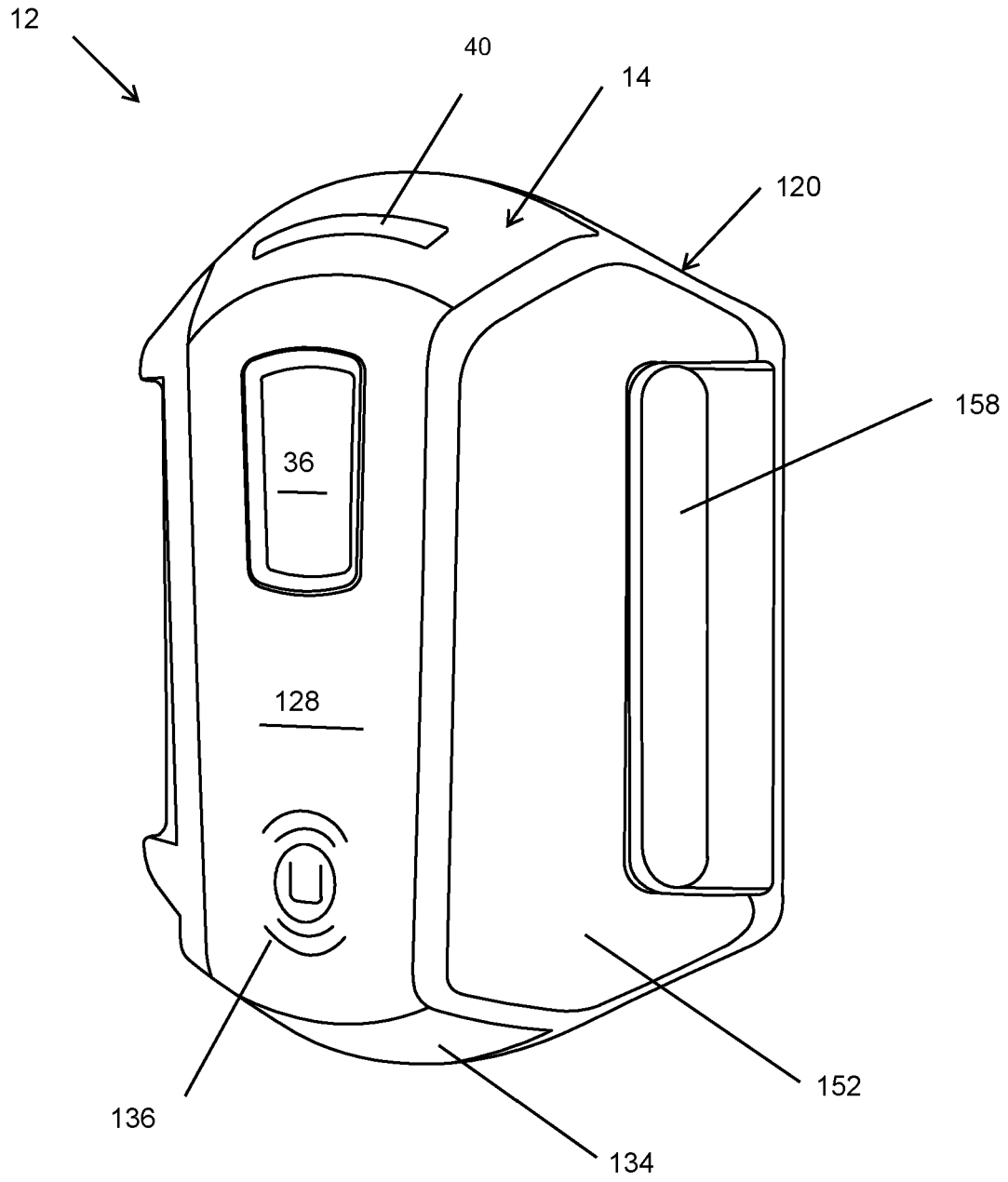
FIG. 10 is another perspective view of the system shown in FIGS. 5 through 9, the view showing the core fully inserted within the opening of the holster; the view showing the band removed.
Figure 11:
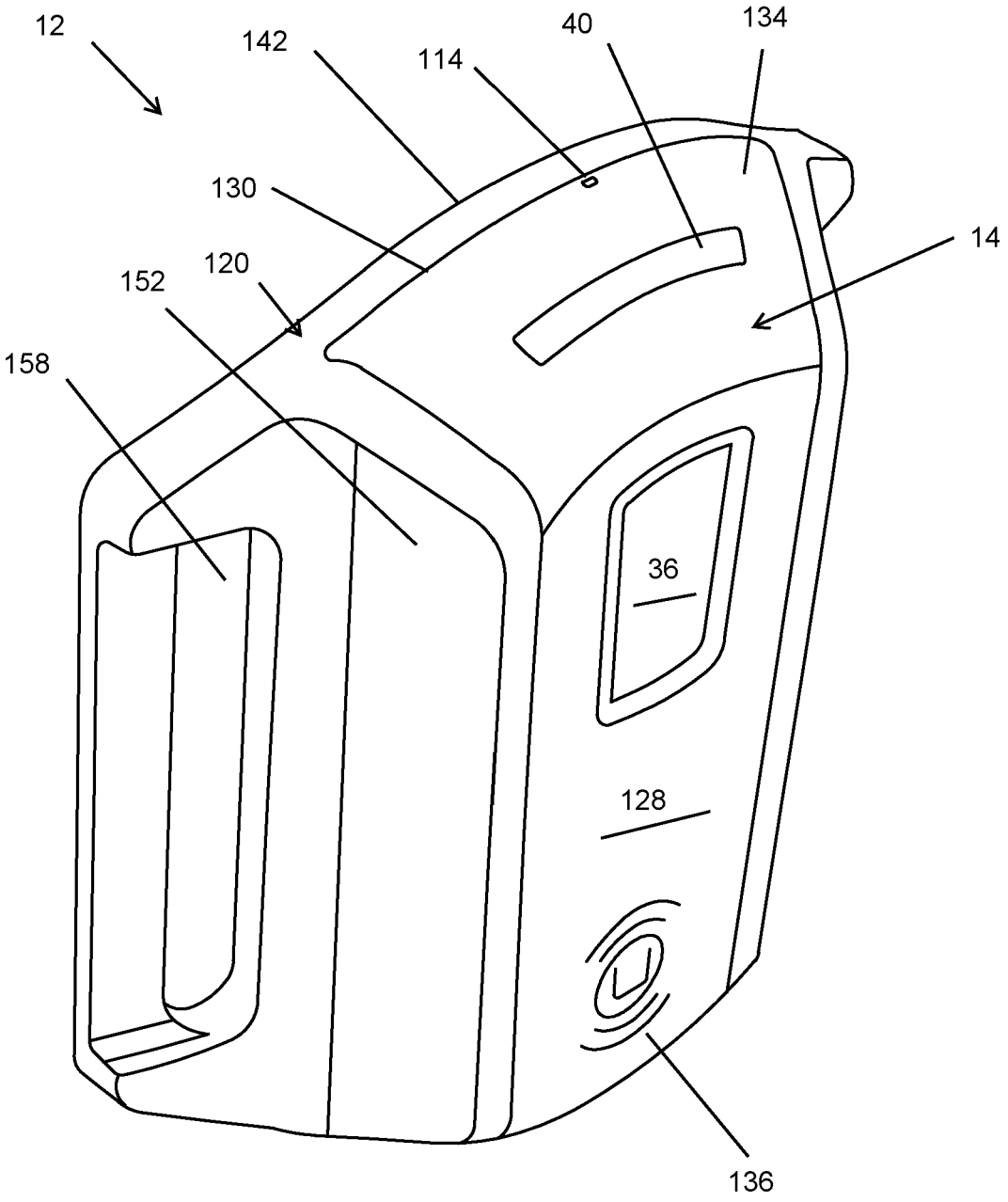
FIG. 11 is another perspective view of the system shown in FIGS. 5 through 10, the view showing the core fully inserted within the opening of the holster; the view showing the band removed.
Figure 12:
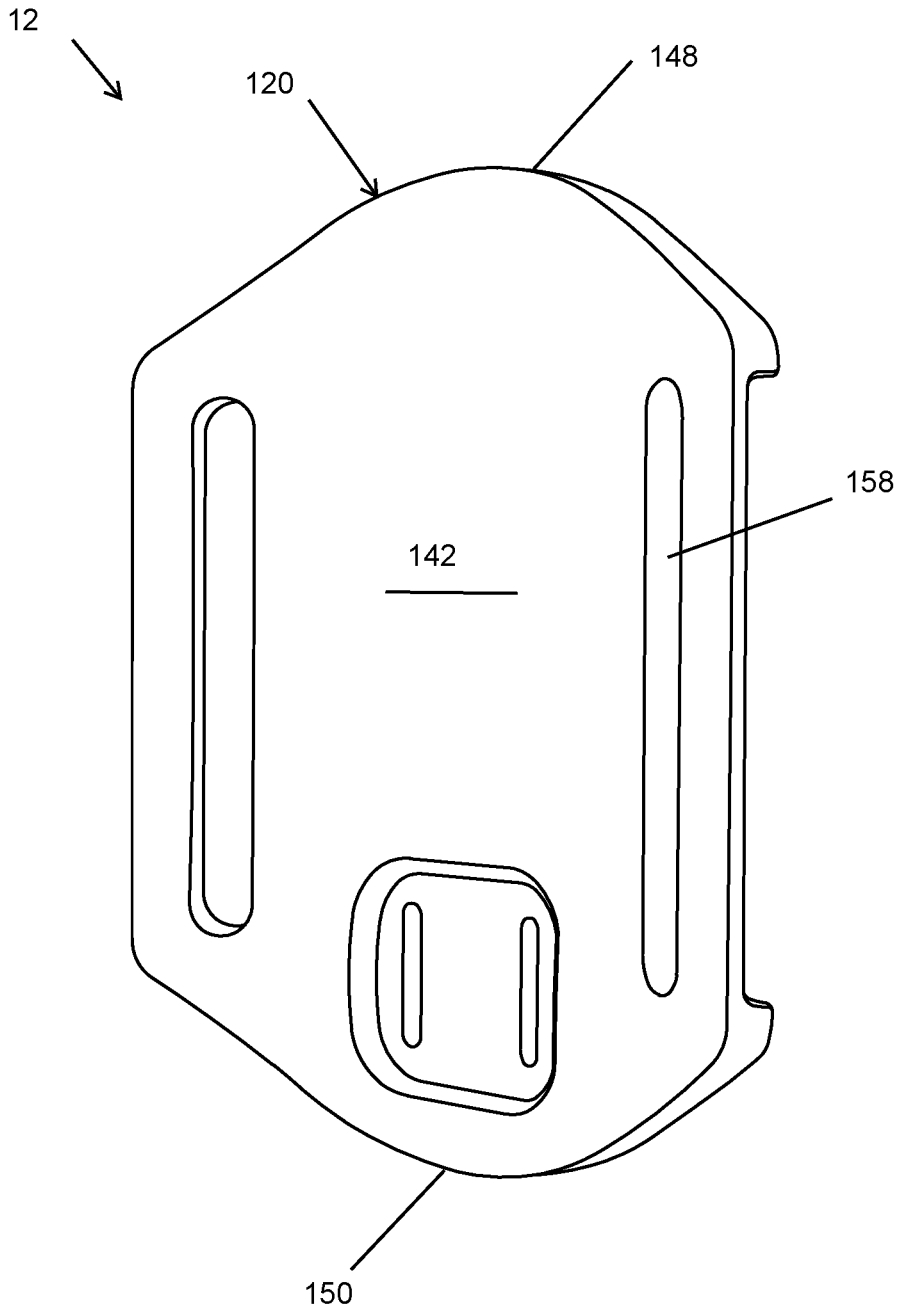
FIG. 12 is another perspective view of the system shown in FIGS. 5 through 11, the view showing the core fully inserted within the opening of the holster; the view showing the band removed; the view showing the back side of the holster.
Figure 13:
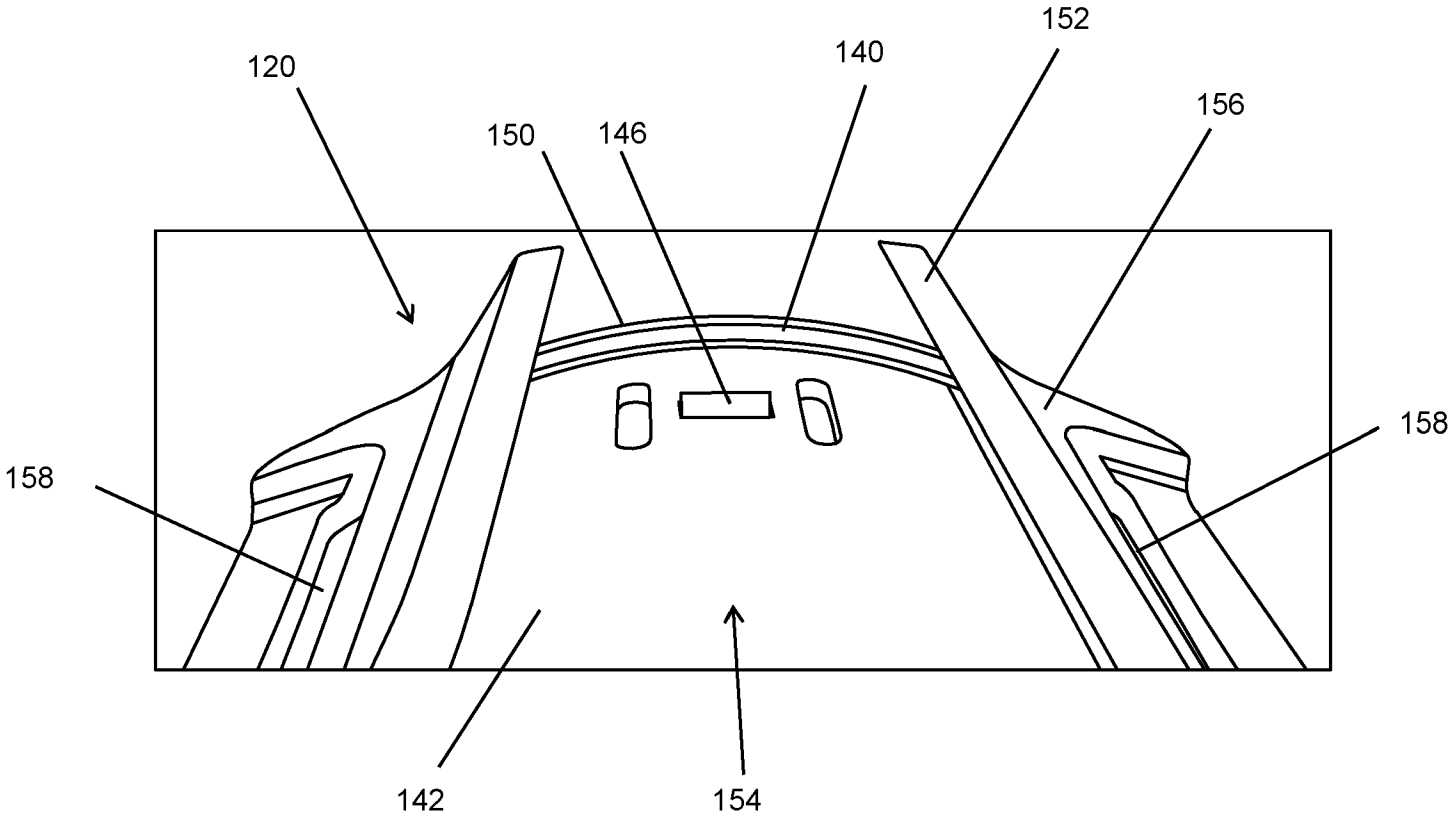
FIG. 13 is a partial perspective view of the holster of the system, the view showing the opening in the holster between opposing sidewalls and the back wall that is sized and shaped to receive the core therein; the view also showing the detent mechanism in the back wall that is configured to engage the core and hold the core within the opening of the holster; the view also showing the step positioned in the lower end of the back wall between the sidewalls that is configured to engage the lower end of the core and prevent the core from sliding out the lower end of the opening.
Figure 14:
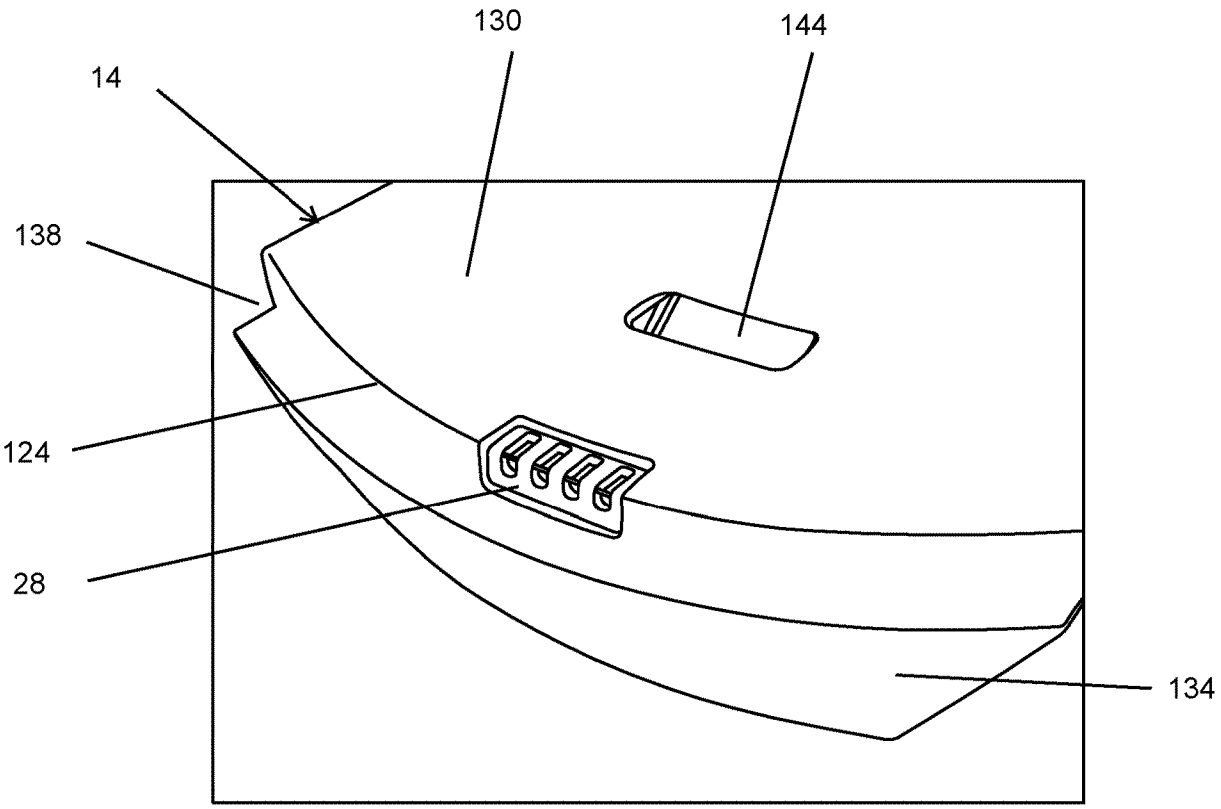
FIG. 14 is a partial perspective view of the back side of the lower end of the core, the view showing the detent mechanism in the back wall that is configured to engage the detent mechanism in the holster and hold the core within the opening of the holster; the view also showing the step positioned in the lower end of the back wall between the sidewalls that is configured to engage the lower end of the opening of the holster and prevent the core from sliding out the lower end of the opening; the view also showing the port with a plurality of connection pins positioned in the lower end of the back wall at the step, the port configured to provide charging capabilities as well as data transfer capabilities when plugged into the charging base or other components of the system.
Figure 15:
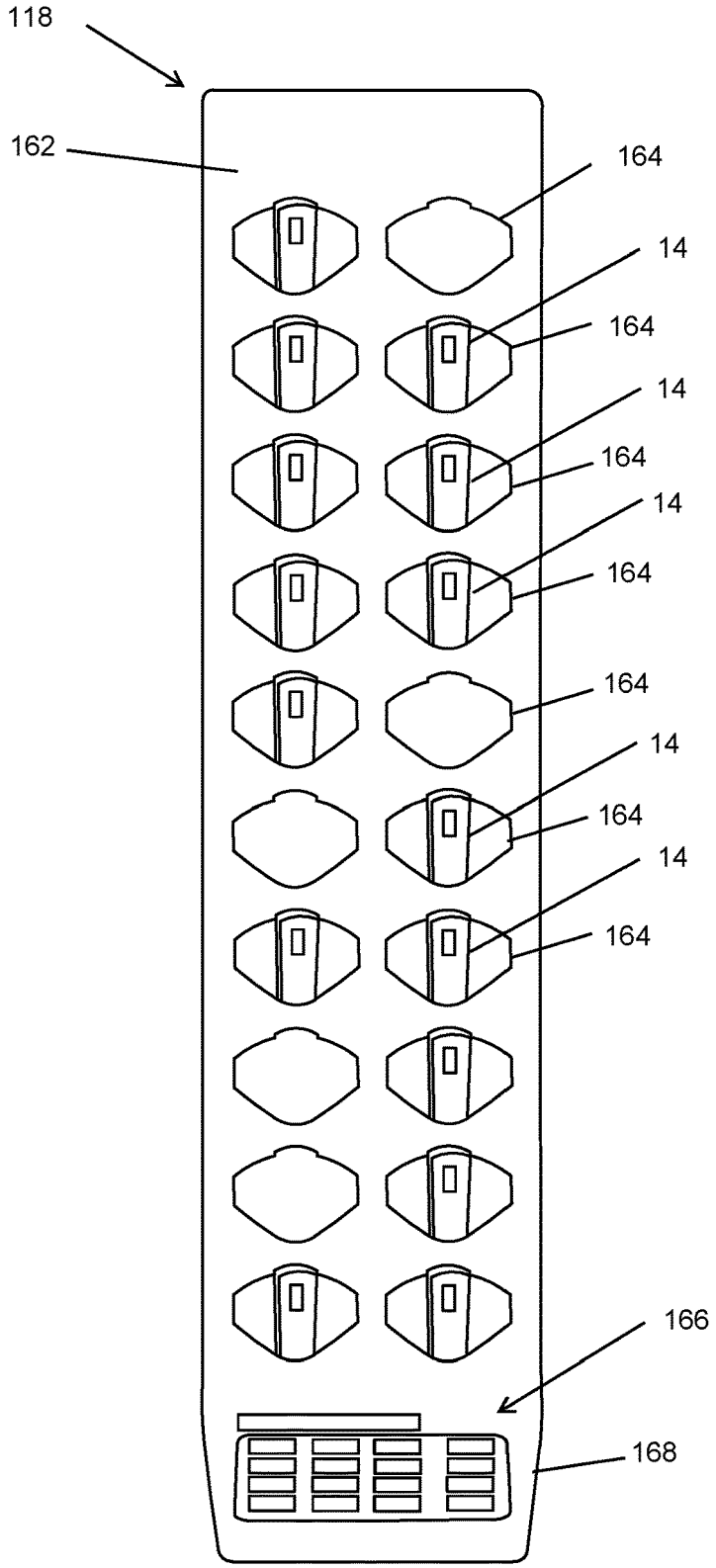
FIG. 15 is an elevation view of a charger base of the system; the view showing the charger base having a back wall and a lower wall, the back wall having a plurality of sockets that are sized and shaped to receive cores therein such that once the cores are plugged into the charger base the cores are charged as well as data transfer occurs between the charger base (and the other components of the system) and the core; the view also showing a user interface positioned in the lower wall of the charger base, the user interface allows a worker to interact with the charger base, such as scanning in or typing in their user information so as to facilitate the allocation of a core to the worker; the view showing a plurality of sockets occupied by cores and a plurality of sockets unoccupied by cores.
Figure 16:
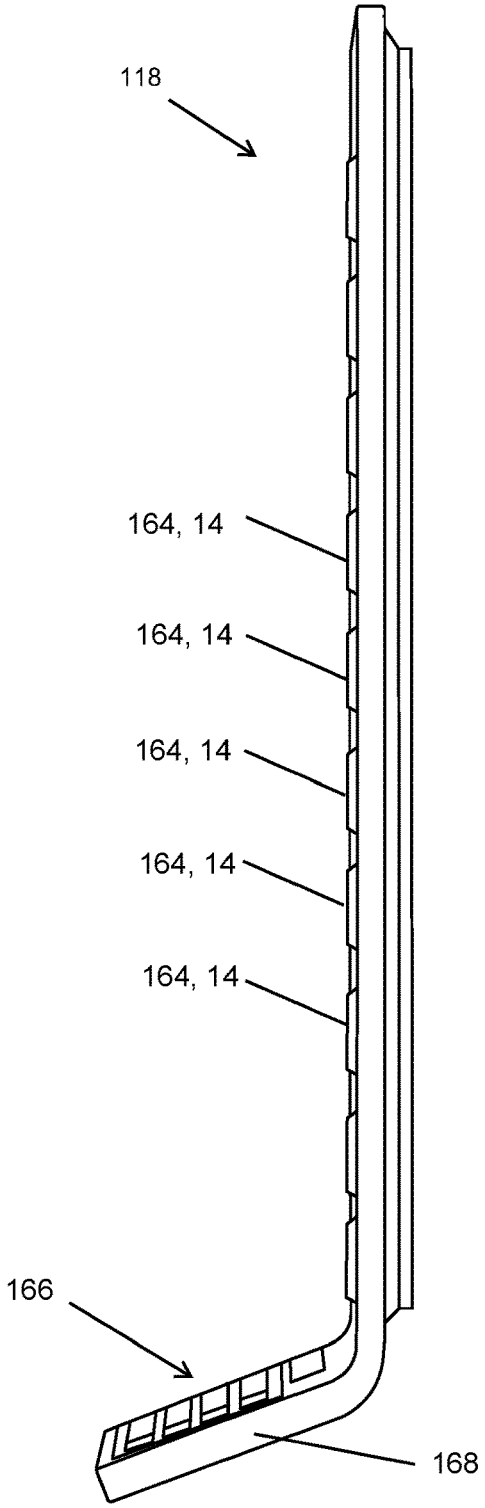
FIG. 16 is an elevation view of a charger base shown in FIG. 15; the view showing the charger base having a back wall and a lower wall, the back wall having a plurality of sockets that are sized and shaped to receive cores therein such that once the cores are plugged into the charger base the cores are charged as well as data transfer occurs between the charger base (and the other components of the system) and the core; the view also showing a user interface positioned in the lower wall of the charger base, the user interface allows a worker to interact with the charger base, such as scanning in or typing in their user information so as to facilitate the allocation of a core to the worker.
Figure 17:
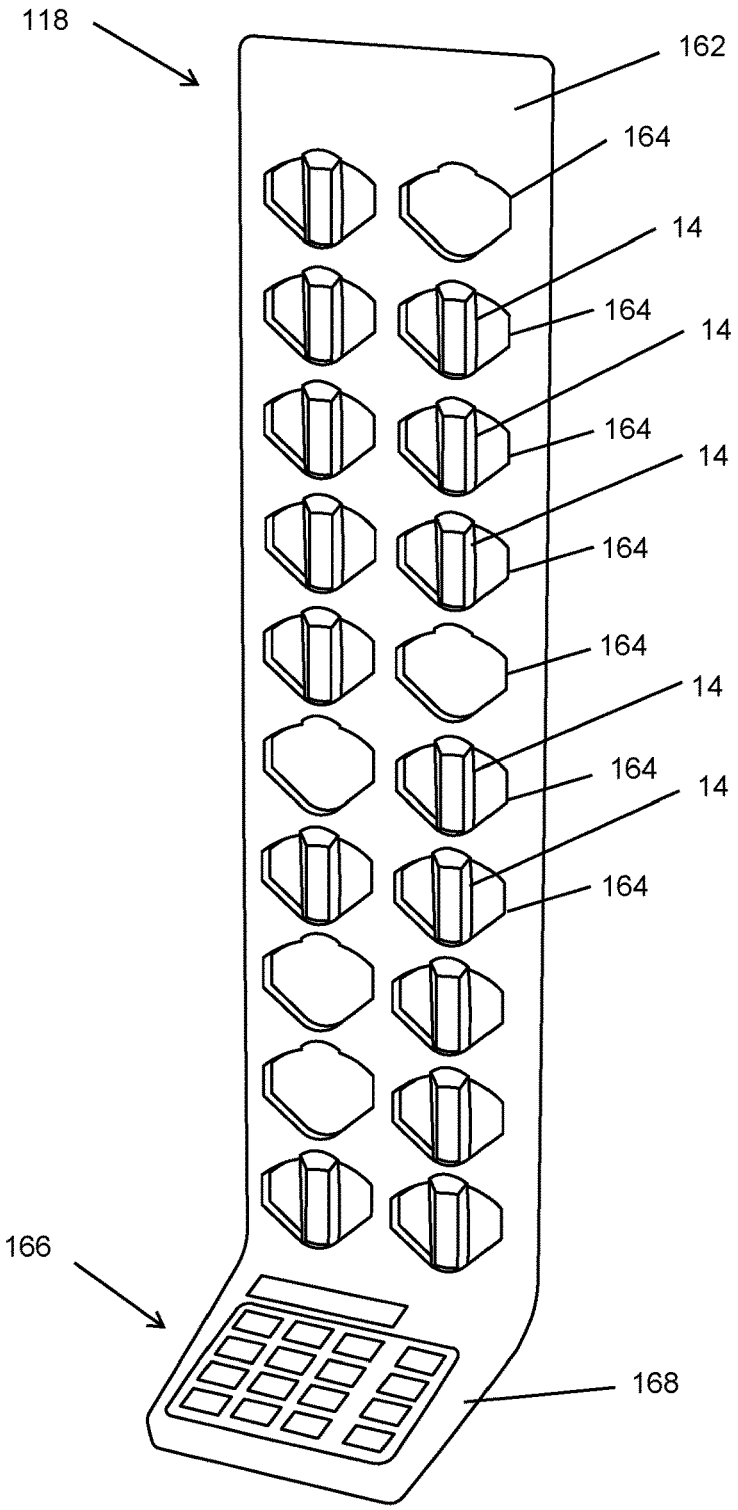
FIG. 17 is a perspective view of a charger base shown in FIGS. 15 and 16; the view showing the charger base having a back wall and a lower wall, the back wall having a plurality of sockets that are sized and shaped to receive cores therein such that once the cores are plugged into the charger base the cores are charged as well as data transfer occurs between the charger base (and the other components of the system) and the core; the view also showing a user interface positioned in the lower wall of the charger base, the user interface allows a worker to interact with the charger base, such as scanning in or typing in their user information so as to facilitate the allocation of a core to the worker; the view showing a plurality of sockets occupied by cores and a plurality of sockets unoccupied by cores.

Example of Core, Holster and Attachment Member:

With reference to FIGS. 5-14, one configuration of a safety device 12 is presented that includes a core 14, holster 120 and attachment member 16 among other components as is described herein.

Core:

Core 14 is formed of any suitable size, shape and design and is configured to house the electronic components of safety device 12 and fit in and be held by holster 120 in a removable manner. In the arrangement shown, as one example, core 14 includes an upper end 122, a lower end 124, opposing sides 126, an exterior surface 128, a back wall 130 and a forward wall 132. In the arrangement shown, as one example, the size and shape of core 14 narrows slightly as it extends from upper end 122 to the lower end 124. This slight narrowing facilities the insertion of core 14 within holster 120 and ensures that core 14 may be held within holster 120 in a removable manner while ensuring that the core 14 does not come out of holster 120 in an unintentional manner. Also, in the arrangement shown, core 14 slightly narrows as it extends from the back wall 130 to the forward wall 132 so as to also facilitate easy insertion within holster 120 while preventing unintentional removal of core 14 from holster 120.

More specifically, in one arrangement, as is shown, the forward wall 132 and back wall 130 narrow slightly toward one another as they extend from upper end 122 to lower end 124 such that the lower end 134 is slightly narrower or slightly smaller in stature than the upper end 122. Similarly, opposing sides 126 of core 14 narrow slightly toward one another as they extend from upper end 122 to lower end 124 such that the lower end 134 is slightly narrower or slightly smaller in stature than the upper end 122.

Also, as is shown, opposing sides 126 angle toward one another as they extend from back wall 130 to forward wall 132. Such that the forward wall 132 or forward side of core 14 is slightly narrower or slightly smaller in stature than the back wall 130 or back side of core 14. In one arrangement, as is shown, the shape of core 14 slightly curves or contours so as to comfortably fit around the worker's arm. In this arrangement, the back surface of the back wall 130 has a slightly concave shape and the forward wall 132 has a slightly convex shape. This slightly curved or arcuate shape makes core 14 slightly more comfortable to wear. In an alternative arrangement, the forward wall 132 and/or back wall 130 are relatively flat or straight or not curved whereas the back wall of the holster 120 is curved in a concave manner thereby providing a comfortable feel for worker 102.

Also, as is shown, the upper end 122 and lower end 124 of core 14 include end walls 134. The opposing end walls 134 angle toward one another as they extend from back wall 130 to forward wall 132. That is, the upper positioned end wall 134 connects at its upper end to back wall 130 and at its sides to the upper end of sides 126 and extends slightly downward therefrom until connecting at its lower end to the upper end of forward wall 132. Similarly, the lower positioned end wall 134 connects at its lower end to back wall 130 and at its sides to the lower end of sides 126 and extends slightly upward therefrom until connecting at its upper end to the lower end of forward wall 132.

In the arrangement shown, core 14 is relatively small and has a low profile with a smooth exterior surface 128. The small size and smooth exterior surface 128 and configuration of core 14 helps to prevent the safety device 12 from being in the way while being worn and further prevents the safety device 12 from being hung-up or caught during use thereby causing a safety issue itself.

In the arrangement shown, as one example, the exterior surface 128 of the core 14 includes indicia 136 thereon. Indicia 136 can be any visual indication such as a logo or design, a model number, a unit number, the ID 44 of that particular core 14, instructions, lost and found information, owner info, or any other information. This indicia 136 may be included on the forward wall 132, which is outwardly facing and visible to others, or indicia 136 may be on back wall 130, sides 126, upper or lower end walls 134 or on any other portion of core 14. The inclusion of indicia 136 may improve the ease of use of system 10 by allowing for quick visual identification of core 14.

In one arrangement, as is shown, the upper positioned end wall 134 includes visual indicator 40 therein. In the arrangement shown, as one example, this visual indicator 40 is a transparent or semitransparent component positioned in the exterior surface 128 of core 14 that is positioned to cover or operably connect to a light or LED housed within the hollow interior of core 14 which is configured to cover the light or LED to protect it during wear while facilitating the transport of light generated by the light or LED through the material of core 14 so that it can be visually seen by the worker 102 as well as others around the worker 102. While only a single visual indicator 40 is shown in core 14, any number of visual indicators 40 are hereby contemplated for use. While the visual indicator 40 is shown in the upper positioned end wall 134, it is hereby contemplated for use that the visual indicator 40 may be positioned in any portion of core 14.

In one arrangement, the transparent component of visual indicator 40 may double as a light pipe 116 for light sensor 30D, or alternatively, this component is separated into two components or portions, with one component or portion serving to transport light from the light or LED to the exterior to serve as a visual indicator and the other component or portion serving as the light pipe 116 to transfer light from the exterior of core 14 to the light sensor 30D. In an alternative arrangement, a separate light pipe 116 is positioned in the exterior surface 128 of core 14 and facilitates the transfer of light from the environment to the light sensor 30D. Light pipe 116 is operatively connected to the light sensor 30D within core 14 and facilitates transfer of light from the environment to the light sensor 30D for tracking of light conditions around the worker.

In one arrangement, as is shown, the upper positioned end wall 134 includes one or more openings 114 therein. In the arrangement shown, as one example, one or more openings 114 provide a passageway through the material of core 14 thereby providing access to the sensors 30 held within core 14, such as sound sensor 30A, air quality sensor 30E or any other sensor 30 that requires access to air for sensing purposes. While only a single opening 114 is shown in core 14, any numbers of openings 114 are hereby contemplated for use. While the opening 114 is shown in the upper positioned end wall 134, it is hereby contemplated for use that the opening(s) 114 may be positioned in any portion of core 14.

In the arrangement shown, core 14 includes event trigger 36 therein. Event trigger 36 is formed of any suitable size, shape and design and is configured to be engaged by the worker 102 whenever an accident, near miss or notable event occurs. Once engaged, the event trigger 36 causes core 14 to store a high-density of information for a predetermined amount of time or period, as well as record audible information from the worker 102 and then transmit this information in a safety report or a notable event report or other report as is described herein. In the arrangement shown, as one example, event trigger 36 takes the form of a button placed in the exterior surface 128 of forward wall 132 which provides easy access to event trigger 36. In the arrangement shown, event trigger 36 is a recessed or depressed button which helps to prevent unintentional engagement of the event trigger 36 which helps to reduce the number of false-positives. In one arrangement, a raised ring or protective cover may be placed over or around event trigger 36 to further reduce unintentional engagement of event trigger 36. In the arrangement shown, event trigger 36 is positioned in the upper end of forward wall 132, however any other position is hereby contemplated for use.

In one arrangement, as is shown, the lower end of back wall 130 includes a step 138 therein. In the arrangement shown, as one example, step 138 is a notch or recess in the lower end 124 of the lower positioned end wall 134. This step 138 provides a structural feature that engages the lower end of holster 120 thereby facilitating full frictional and locking engagement between holster 120 and core 14. In the arrangement shown, step 138 is a generally right-angled groove that extends from side 126 to side 126 at the intersection of back wall 130 and lower end wall 134. A similar but opposite step 140 is positioned in the lower end of back wall 142 of holster 120. The engagement of step 138 of core 14 with the step 140 of holster 120 establishes the fully inserted position of core 14 within holster 120 and prevents the core 14 from sliding out of the lower end of holster 120.

In the arrangement shown, as one example, port 28 is positioned at or in association with step 138. In the arrangement shown, as one example, port 28 includes a plurality of conductive pins that are accessible at the lower end of back wall 130. The pins of port 28 facilitate charging of the power source 26 within core 14 when core 14 is plugged into charger base 118. The pins of port 28 facilitate data-transfer from memory 20 to the other components of system 10 when core 14 is plugged into charger base 118. The position of port 28 in the lower end of back wall 130 at step 138 provides protection for the pins of port 28 when core 14 is fully inserted within holster 120. This is because, when core 14 is held within holster 120, port 28 is covered by the back wall 142 and step 140 of holster 120.

A detent 144 is also positioned in the lower end of back wall 130. Detent 144 is any device or component that helps to facilitate locking but removable connection of core 14 to holster 120. In the arrangement shown, detent 144 of core 14 is an angled recess that is configured to receive a corresponding detent 146 positioned in the lower end of back wall 146 of holster 120. In the arrangement shown, as one example, detent 146 in the back wall 142 of holster 120 is angled protrusion that fits with close and tight tolerances and frictional engagement within the detent 144 of core 14 when core 14 is fully inserted within holster 120. Any number of detents 144, 146 are hereby contemplated for use as is any size, shape and design for detents 144, 146.

Holster:

Holster 120 is formed of any suitable size, shape and design and is configured to house and hold core 14 therein in a removable manner while core 14 is worn by a worker 102. In the arrangement shown, as one example, holster 120 includes an upper end 148, a lower end 150, opposing side walls 152, and a back wall 142 that form an opening 154 that is sized and shaped to receive core 14 therein. In the arrangement shown, as one example, the size and shape of opening 154 of holster 120 narrows slightly as it extends from upper end 148 to the lower end 150 in conforming shape with the exterior surface 128 of core 14. This slight narrowing facilitates the insertion of core 14 within holster 120 and ensures that core 14 may be held within holster 120 in a removable manner while ensuring that the core 14 does not come out of holster 120 in an unintentional manner. Also, as is shown, opposing sides 152 angle toward one another as they extend from upper end 148 to lower end 150. This causes the opening 154 therein to be s slightly narrower or slightly smaller at the lower end 150 of opening 154 as opposed to the upper end 148.

In one arrangement, as is shown, the shape of holster 120 slightly curves or contours so as to comfortably fit around the worker's arm. In this arrangement, the back surface of the back wall 142 has a slightly concave shape. This slightly curved or arcuate shape makes holster 120 slightly more comfortable to wear.

In the arrangement shown, holster 120 is relatively small and has a low profile with a smooth exterior surface 156. The small size and smooth exterior surface 156 and configuration of holster 120 helps to prevent the safety device 12 from being in the way while being worn and further prevents the safety device 12 from being hung-up or caught during use thereby causing a safety issue itself.

In one arrangement, as one example, the exterior surface 156 of the holster 120 includes indicia 136 thereon. Indicia 136 can be any visual indication such as a logo or design, a model number, a unit number, the ID 44 of that particular holster, the owner's name, instructions, lost and found information, or any other information. This indicia 136 may be included on the on any portion of holster 120.

In one arrangement, as is shown, the lower end of back wall 142 includes a step 140 therein. In the arrangement shown, as one example, step 140 is a generally right angled protrusion in the lower end 150 back wall 142. This step 140 provides a structural feature that engages the lower end of core 14 thereby facilitating full frictional and locking engagement between holster 120 and core 14. In the arrangement shown, step 140 is a generally right-angled protrusion that extends from side wall 152 to side wall 152 at the intersection of back wall 142 and side walls 152 at the lower end 150 of holster 120. A similar but opposite step 138 is positioned in the lower end of core 14. The engagement of step 138 of core 14 with the step 140 of holster 120 establishes the fully inserted positon of core 14 within holster 120 and prevents the core 14 from sliding out of the lower end of holster 120.

A detent 146 is also positioned in the lower end of back wall 142. Detent 146 is any device or component that helps to facilitate locking but removable connection of core 14 to holster 120. In the arrangement shown, detent 146 of holster 120 is an angled protrusion that is configured to engage and be received within a corresponding detent 144 positioned in the lower end of back wall 130 of core 14. In the arrangement shown, as one example, detent 146 in the back wall 142 of holster 120 is angled protrusion that fits with close and tight tolerances and frictional engagement within the detent 144 of core 14 when core 14 is fully inserted within holster 120. Any number of detents 144, 146 are hereby contemplated for use as is any size, shape and design for detents 144, 146.

Holster 120 is configured to be connected to worker 102 by any manner, method or means. In one arrangement, as is shown, holster 120 includes an opening 158 positioned at each opposing side of holster 120. These openings 158 are configured to receive or connect to a portion of attachment member 16. In the arrangement shown, attachment member 16 is an elastic band that extends between opposing ends 160. In the arrangement shown, the ends 160 of bands 16 are passed through the openings 158 of holster 120 and the band is tightened on itself by way of the frictional engagement of a hook-and-loop arrangement (such as Velcro® or the like systems) buttons, snaps, or any other manner or method of connecting two components together. In this way, holster 120 and core 14 are comfortably connected to worker 102. In an alternative arrangement, the worker 102 can pass their belt though the openings 158 and attach the holster 120 and core 14 in that manner.

In an alternative arrangement, instead of holster 120 having a band that serves as an attachment device 16, attachment device 16 is a clip that can be clipped onto a user's shirt, helmet, belt or any other piece of clothing or equipment.

It has been found that workers 102 like having their own bands (attachment devices 16) and their own holsters 120. This is because the worker 102 actually physically engages these components. By having personal bands and holsters 120 this is more sanitary and comfortable for the workers 102. In addition, by separating the core 10, holster 120 and band 16, this allows for replacement of the core 10, holster 120 and band 16 separately. That is, if one of these components fails or wears out (as is often the case with an elastic band as the attachment member 16) this single component of the system 10 can be replaced without throwing away the other components.

Themed Safety Devices:

In one arrangement, the attachment member 16, holster 120 and core 14 are colored with the colors of the companies that use them and include the logos or other indicia of the companies that use them. This provides a fun appeal to the system 10, and also makes it easier to identify who the owner of the components are.

In another arrangement, the worker 102 can order custom colored or themed holsters 120, bands 16 and/or cores 14, such as in the motif of their favorite sports team or the like.

Charger Base:

In the arrangement shown, system 10 includes a charging base 118. Charging base 118 is formed of any suitable size, shape and design and is configured to receive, charge and transfer information from and to cores 14. In the arrangement shown, as one example, charging base 118 includes a back wall 162 that includes a plurality of sockets 164 that are sized and shaped to receive cores 14 therein. When cores 14 are placed within sockets 164, cores 14 are charged by charging base 118 and data transfer occurs between core 14 and charging base 118 and the other components of the system 10.

Charging base 118 also includes a user interface 166, which in the arrangement shown is included in a lower wall 168. User interface 116 provides the ability for the workers 102 to interact with the charging base 118 and may include a plurality of sensors, a key pad, a biometric scanner, a touch screen or any other input for information. As one example, at the beginning of a shift, a worker 102, with or wearing their own personal holster 120 engages the charger base 118 by biometrically scanning in with a finger or thumb print, a retinal scan, facial recognition, voice recognition or the like or any combination thereof; or alternatively, the worker 102 types in their name, employee ID number, swipes an employee ID card, scans in using their phone or any other manner or method of associating their personal identification with the system 10.

Upon receiving this information, charger base 118 and system 10 identifies the worker 102 and allocates a core 14 held within the charger base 118 that is fully charged, or has the highest charge among the cores 14, and assigns that core 14 to that worker 102 by illuminating the core 10, illuminating the socket 164 that the core 14 is held in, or providing the socket number to the worker 102 or by identifying which core 14 the worker 102 is to take by any other manner, method or means. Also, in association with this process, system 10 programs core 14 with the proper threshold levels and other information that is particular to that worker's job. For instance, for a worker in a heavy industrial position that wears external protective gear (such as ear muffs) the thresholds will be substantially different than the thresholds for a worker in a light clerical role that does not wear any protective gear. This ensures that proper safety thresholds are identified for each worker 102 in each role. This ensures that unnecessary safety concerns are maintained at a minimum.

Once the proper core 14 has been identified to the worker 102, the worker 102 retrieves that core 14 from the charger base 118, slides the core 14 into their holster 120 and the worker 102 begins their shift and the core 14 begins recording information in the manner described herein.

At the end of the shift, the worker 102 returns the core to the charging base 118. Once the core 14 is plugged into a socket 164, the charger base 118 begins charging the core 14 and begins retrieving data from the core 14 for distribution into the system 10 and saving into database 34 among other uses as is described herein. The system 10 also updates the software or firmware on the core 14 and prepares the core 14 for another use.

In one arrangement, charging base 118 includes its own communication equipment, such as a cellular communication module. In this arrangement, charging base 118 can communicate completely independently of the internet service or other communication service utilized by the manufacturing facility. This independence ensures that the charging base 118 has the best possible ability to get accurate and timely information to the database 34, electronic network 104, management software 108 and other components of the system 10, so as to ensure timely and accurate reporting of safety events, near misses, accidents and notable events. This independent communication structure also prevents the addition of charging base 118 and system 10 from being a drag on the internet or other communication structure of the manufacturing facility. This independent communication also ensures that the charging base 118 itself can send out text messages and emails directly to the safety manager 112 or others without delay when an accident occurs. In an alternative arrangement, the charging base 118 connects to the internet or communication service utilized by the manufacturing facility. In yet another alternative arrangement, the charging base 118 includes both an independent communication structure as well as connecting to the internet or communication service utilized by the manufacturing facility which provides the benefits of redundancy and back-up in the event that one system is not working.

To be clear, core 14 may transfer data in any of a number of manners. In one arrangement, periodically during use core 14 transmits information to other components of the system 10. This may occur at a convenient time, such as when the core 14 establishes a strong wireless connection with other components of the system 10, or when there is low utilization on the system 10, or the like. In another arrangement, core 14 stores data on its memory 20 and transmits this data to other components of the system 10 when core 14 is plugged into charger base 118, directly into an internet-connected lead (such as an Ethernet cable, or mini-Ethernet cable, or the like). In another arrangement, core 14 transfers data both periodically through a wireless connection to other components as well as when core 14 is plugged into charger base 118 or another internet-connected device. In this way, the system 10 and/or core 14 can transmit information in the most efficient manner and in accordance with the urgency of the information. That is, urgent information, such as a safety issue, may be transmitted immediately, whereas mundane data collected for data mining purposes may be stored and transmitted in a more-efficient and less burdensome manner when core 14 is plugged into charger base 118. This flexibility of data transfer provides efficiencies and helps the system 10 operate in the most efficient manner possible.

Outdoor Version:

While the arrangements described primarily herein discuss use of core 14 and/or system 10 within a manufacturing facility where core 14 communicates using Wi-Fi or other close-proximity wireless communication technology, it is contemplated that in other arrangements it is desirable to use the system 10 outside of the constraints of a single building or a single manufacturing facility or campus. In these arrangements, core 14 is equipped with its own cellular communication module which facilitates the operation of the system 10 described herein without the need to be constrained to any particular geographic area. In this arrangement, core 14 communicates with system 10 in the manners described herein through communication with existing third-party cellular towers, much in the same way that a conventional cellular phone communicates with these towers. This information is then routed through the electronic network 104 to database 34 and the other components of system 10.

This arrangement is desirable for companies that have a dispersed workforce such as package delivery companies such as Fed-Ex and UPS, railroads, companies that do on-site repair and installation such as heating and air conditioning companies and plumbing companies, or any other company with a dispersed workforce that is not housed or constrained within a building or campus. Other than having cellular communication capabilities, this outdoor version of the core 14 operates in a similar if not identical manner to that described herein and facilitates the accomplishment of the same if not identical objectives.

From the above discussion it will be appreciated that the safety device, system and method of use presented improves upon the state of the art.

Specifically, the safety device, system and method of use presented: standardizes the collection of information about the environmental conditions of a workplace; does not penalize any one employee for reporting information about the environmental conditions of a workplace; aggregates a great amount of information about the environmental conditions of a workplace; eliminates the bias in the collection of information about the environmental conditions of a workplace; eliminates the inconsistency in reporting information about the environmental conditions of a workplace; provides workers the ability to quickly and easily report near misses; allows for the prediction of future workplace injuries; allows for the elimination of future workplace injuries; provides insight into the safety conditions of a workplace; allows for the identification of patterns in safety conditions; reports information about the environmental conditions of a workplace without substantially inconveniencing workers; provides notifications if safety thresholds are approached or exceeded; improves the access to information about the environmental conditions of a workplace; improves the visibility to information about the environmental conditions of a workplace; reduces workplace injuries; improves the safety of workers and work places; is safe to use; is easy to use; is efficient to use; provides a unique; is cost effective; is durable; is robust; can be used with a wide variety of manufacturing facilities; is relatively inexpensive to implement; has a long useful life; is high quality; is convenient; can be used with a wide variety of employees; provides high quality data; provides data and information that can be relied upon; reduces response time to potentially dangerous situations, among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A wearable safety device system comprising:

a wearable safety device, comprising:

a core;

a microprocessor;

the microprocessor housed within the core;
memory operatively connected to the microprocessor;
a transceiver operatively connected to the microprocessor;
an antenna operatively connected to the transceiver;
a power source electrically connected to the microprocessor;
at least one sensor operatively connected to the microprocessors;
an event trigger operatively connected to the microprocessor;
wherein the wearable safety device is worn by a worker;
wherein the at least one sensor senses environmental conditions surrounding the worker while the wearable safety device is being worn;
wherein when the worker experiences a notable event, the worker activates the event trigger and the wearable safety device records environmental information surrounding the worker around the time the event trigger is activated, as well as a sound recording around the time the event trigger is activated.

2. The system of claim 1, wherein the at least one sensor is selected from the group consisting of: a sound sensor; a light sensor; a temperature sensor; an air quality sensor; a CO sensor; a humidity sensor; a barometric pressure sensor; a location sensor; and an accelerometer.

3. The system of claim 1, wherein the event trigger is a button which is pressed when a near miss or accident occurs.

4. The system of claim 1, wherein when the worker encounters a notable event, the worker engages the event trigger and the wearable safety device records an audible message from the worker.

5. The system of claim 1, wherein when the worker encounters a notable event, the worker engages the event trigger and the wearable safety device records environmental conditions around the time the event trigger is engaged.

6. The system of claim 1, wherein the wearable safety device transmits information regarding the environmental conditions surrounding the worker to a database.

7. The system of claim 1, wherein the wearable safety device includes an audible indicator, or a visual indicator, or a physical indicator that provides information to the worker.

8. The system of claim 1, wherein the wearable safety device includes a microphone configured to record audible messages from the worker.

9. The system of claim 1, wherein when the event trigger is activated, an alert message is transmitted to a safety manager.

10. The system of claim 1, wherein the wearable safety device is configured to automatically detect when a near miss or an accident occurs.

11. The system of claim 1, wherein the core is removably held within a holster, wherein the holster connects to the worker.

12. A method of improving the safety of workers in a manufacturing facility, the steps comprising:
providing a wearable safety device, the wearable safety device having at least one sensor configured to sense environmental conditions and an event trigger;
attaching the safety device to a worker;
sensing environmental conditions surrounding the worker by the at least one sensor as the wearable safety device is worn by the worker;
transmitting the sensed environmental conditions surrounding the worker to a database;
storing the sensed environmental conditions surrounding the worker in the database;
activating the event trigger by the worker when a notable event occurs;
transmitting information related to the notable event to the database including the location of the notable event and environmental conditions at the time of the notable event;
recording environmental information surrounding the worker around the time the event trigger is activated, as well as sound recording around the time the event trigger is activated by the wearable safety device.

13. The method of claim 12, wherein the wearable safety device includes:
a core;
a microprocessor;
the microprocessor housed within the housing;
memory operatively connected to the microprocessor;
a transceiver operatively connected to the microprocessor;
an antenna operatively connected to the microprocessor;
a power source electrically connected to the microprocessor.

14. The method of claim 12, wherein the at least one sensor is selected from the group consisting of: a sound sensor; a light sensor; a temperature sensor; an air quality sensor; a CO sensor; a humidity sensor; a barometric pressure sensor; a location sensor; and an accelerometer.

15. The method of claim 12, wherein the event trigger is a button.

16. The method of claim 12, wherein the safety device transmits information regarding the environmental conditions surrounding the worker to a database.

17. The method of claim 12, further comprising the step of automatically detecting when a near miss or accident occurs.

18. The method of claim 12, wherein when the worker encounters a notable event, the worker engages the event trigger and the wearable safety device records an audible message from the worker.

19. A wearable safety device system, comprising:
a wearable safety device, comprising:
a core;
a microprocessor;
the microprocessor housed within the core;
memory operatively connected to the microprocessor;
a transceiver operatively connected to the microprocessor;
an antenna operatively connected to the transceiver;
a power source electrically connected to the microprocessor;
at least one sensor operatively connected to the microprocessor;
wherein the wearable safety device is worn by a worker;
wherein the at least one sensor senses environmental conditions surrounding the worker;
wherein the wearable safety device is configured to automatically detect when an accident occurs;
wherein the wearable safety device records environmental information surrounding the worker around the time the event trigger is activated, as well as a sound recording around the time the event trigger is activated.

20. A wearable safety device system, comprising:
a wearable safety device, comprising:
a core;
a microprocessor;
the microprocessor housed within the core;
memory operatively connected to the microprocessor;

a transceiver operatively connected to the microprocessor;

an antenna operatively connected to the microprocessor;

a power source electrically connected to the microprocessor;

at least one sensor operatively connected to the microprocessors;

wherein the at least one sensor senses environmental conditions surrounding the worker;

wherein the wearable safety device is configured to detect when a safety threshold is exceeded;

wherein the wearable safety device records environmental information surrounding the worker around the time the event trigger is activated, as well as a sound recording around the time the event trigger is activated.

21. The wearable safety device of claim 20, wherein when the wearable device detects a safety threshold has been exceeded, a signal is transmitted to a safety manager informing the safety manager that the safety threshold has been exceeded.

* * * * *